US006322429B1

(12) United States Patent
Wilson et al.

(10) Patent No.: US 6,322,429 B1
(45) Date of Patent: Nov. 27, 2001

(54) CONDITIONER ASSEMBLY AND A CONDITIONER BACK SUPPORT FOR A CHEMICAL MECHANICAL POLISHING APPARATUS

(75) Inventors: Ethan C. Wilson, Sunnyvale; James A. Allen, Hayward; David E. Weldon, Santa Clara; Gregory C. Lee, Sunnyvale; Linh X. Can, San Jose; Jeffrey M. L. Fontana, Fremont; Shou-sung Chang, Sunnyvale; Jade Jaboneta, San Jose, all of CA (US)

(73) Assignee: Mosel Vitelic, Inc., Hsinchu (TW)

( * ) Notice: Subject to any disclaimer, the term of this patent is extended or adjusted under 35 U.S.C. 154(b) by 0 days.

(21) Appl. No.: 09/491,405

(22) Filed: Jan. 26, 2000

Related U.S. Application Data

(62) Division of application No. 09/113,614, filed on Jul. 10, 1998.

(51) Int. Cl.[7] ..... B24B 7/00

(52) U.S. Cl. ..... 451/72; 451/56; 451/296

(58) Field of Search ..... 451/56, 72, 296, 451/303, 307, 443, 444, 311, 490, 495

(56) References Cited

U.S. PATENT DOCUMENTS

| | | | | |
|---|---|---|---|---|
| 5,441,444 | | 8/1995 | Nakajima . | |
| 5,531,635 | | 7/1996 | Mogi et al. . | |
| 5,626,509 | | 5/1997 | Hayashi . | |
| 5,643,067 | | 7/1997 | Katsuoka et al. . | |
| 5,645,473 | | 7/1997 | Togawa et al. . | |
| 5,916,012 | * | 6/1999 | Pant et al. | 451/41 |
| 5,941,762 | * | 8/1999 | Ravkin et al. | 451/56 |
| 5,961,372 | * | 10/1999 | Shendon | 451/41 |

* cited by examiner

*Primary Examiner*—Joseph J. Hail, III
*Assistant Examiner*—Dung Van Nguyen
(74) *Attorney, Agent, or Firm*—Skjerven Morrill MacPherson LLP

(57) ABSTRACT

A conditioner assembly and a conditioner back support for conditioning a polishing pad of a chemical mechanical polishing device. The conditioner assembly comprises a conditioning head having a gimbal assembly, a shaft engaged to the conditioning head, and a linear torque bearing assembly slidably receiving the shaft. The linear torque bearing assembly is configured to operatively rotate the shaft assembly contemporaneously with allowing the shaft to extend and retract from a first open end of the linear torque bearing assembly. The conditioner assembly additionally comprises a bellows secured over the first open end and engaged to the conditioning head and a bearing housing disposed over a second open end of the linear torque bearing assembly.

The conditioner back support respectively opposes the conditioner assembly such that the polishing belt supporting the polishing pad is disposed intermediate to the conditioner back support and the conditioner assembly. The conditioner back support comprises a frame assembly which adjustably support a backing plate. The frame assembly comprises a positioning assembly which allows a user to adjust the position of the backing plate. The position of the backing plate can be adjusted such that a front surface of the backing plate is parallel to and disposed on or proximal to a plane defined by a backside of the polishing belt. As a result, when the conditioner assembly compresses against the polishing pad, the polishing pad does not significantly deflect.

10 Claims, 41 Drawing Sheets

CONDITIONER ASSEMBLY AND A CONDITIONER BACK SUPPORT FOR A CHEMICAL MECHANICAL POLISHING APPARATUS

CROSS-REFERENCE TO RELATED APPLICATION

This is a divisional of U.S. application Ser. No. 09/113,614, filed Jul. 10, 1998, entitled, "A Conditioner Assembly And A Conditioner Back Support For A Chemical Mechanical Polishing Apparatus," now U.S. Pat. No. 6,042,457 issued on Mar. 28, 2000.

BACKGROUND OF THE INVENTION

1. Field of the Invention

This invention relates to chemical mechanical polishing. More specifically, the present invention provides a conditioner assembly and conditioner back support for a chemical mechanical polishing apparatus. Moreover, the present invention provides a method for conditioning a polishing pad of a chemical mechanical polishing apparatus by employing the conditioner assembly and the conditioner back support of the present invention.

2. Discussion of the Background

Sub-micron integrated circuit devices are formed on substrates such as semiconductor wafers by patterning conductive or interconnect film layers (e.g., aluminum (Al), copper (Cu), etc.) which have been deposited on nonconductive or intermediate dielectric film layers (e.g., silicon oxide ($SiO_x$)). In order to pattern or etch the interconnect film layer, the exposed surface of the interconnect film layer must be topographically planar. An intermediate dielectric film layer having a non-planar surface will transfer its topographical profile to that of the deposited interconnect film layer. As a result, prior to the deposition of the interconnect film layer, the surface of the intermediate dielectric layer has to be planarized. To pose the problem more concretely, the patterning and etching step is prepared by selectively developing photoresist layers on the exposed surface of the interconnect film layer. A non-planar surface prevents the focusing of a photolithography apparatus on the entire exposed surface of the interconnect film layer for the exposure of the photoresists. As a result, the interconnect film layer having a surface defined by a non-planar topography cannot be etched or patterned by photolithographic techniques. The syllogism follows that the intermediate dielectric film layer, on which the interconnect film layer is deposited, must have a planarized surface.

Chemical mechanical polishing (CMP) is one recognized method of planarization. CMP technique requires that the substrate be mounted on a polishing head with the surface of the substrate to be polished exposed. The polishing head, supporting the substrate, is then placed against a polishing pad of a linear polishing belt or a planar polishing pad. Referring to FIGS. 50 and 51, which are schematic side elevational and front plan views of a linear CMP apparatus, generally illustrated as 300, there is seen a continuous, vertical polishing belt 302 configured to polish a vertically held substrate, such as a semiconductor wafer 305. A polishing head 301 positions the substrate 305 against a polishing pad 304, which is attached to the vertical polishing belt 302. The polishing belt 302 is kept in continuous motion, as indicated by arrow 308, by rotating pulleys 310 and 312 at a selected polishing speed (e.g., 1–10 meters/second). A support head 314 provides a base for the application of pressure (e.g., 1–10 PSI) by the polishing head 301 against the substrate 305. The polishing head 301 rotates in a clockwise or counter-clockwise direction, as indicated by arrow 316, and is oscillated back and forth, as indicated by arrow 320, by an oscillating arm 318 of a driving mechanism (omitted from the Figures). Moreover, a slurry, typically a mixture of an abrasive and at least one chemically reactive agent, is supplied to the polishing pad 304. Accordingly, a chemical reaction and a mechanical abrasion is provided at an interface between the substrate 305 and the polishing pad 304.

A planar CMP apparatus 400, as illustrated in FIGS. 52 and 53 includes the polishing head 301, horizontally supporting the substrate 305. The polishing head 301, as mentioned above, rotates in a clockwise or counterclockwise direction, as indicated by the arrow 316, and is oscillated back and forth, as indicated by the arrow 320, by the oscillating arm 318 of the driving mechanism (omitted from the Figures). However, in lieu of the continuous, vertical polishing belt 302, a rotating, planar polishing platen 402 is provided. The planar polishing platen 402 supports and rotates the polishing pad 304 about a driving shaft 406. The rotation of the polishing platen 402 is indicated by arrow 408. The slurry is provided to the polishing pad 304 for providing the abrasive chemical solution.

The various motions of the different components of the above-discussed linear 300 and planar 400 CMP apparatus often lead to excessive wear near the center of the polishing pad 304 and less wear in the periphery. Consequently, non-uniformity is introduced through the polishing pad 304 into the intermediate dielectric film layer. To maintain uniformity in the polishing of the exposed surface of the intermediate dielectric film layer and to provide reproducibility of the polishing process, the polishing pad 304, which is typically a polyurethane pad, is required to be conditioned between or during use. Conditioning is necessary to maintain the uniformity of the polishing pad's 304 texture and profile.

SUMMARY OF THE INVENTION

The present invention provides a conditioner assembly for conditioning a polishing pad of a chemical mechanical polishing device. The conditioner assembly comprises a conditioning head having a gimbal assembly, a shaft engaged to the conditioning head, and a linear torque bearing assembly slidably receiving the shaft. The linear torque bearing assembly is configured to operatively rotate the shaft assembly contemporaneously with allowing the shaft to extend and retract from a first open end of the linear torque bearing assembly. The conditioner assembly additionally comprises a bellows secured over the first open end and engaged to the conditioning head. A bearing housing is disposed over a second open end of the linear torque bearing assembly. The bearing housing rotatably supports the linear torque bearing assembly such that a motor assembly can operatively drive the linear torque bearing assembly, the shaft, and the conditioning head.

The present invention also broadly provides a method for conditioning a moving polishing pad of a polishing apparatus (e.g., a chemical mechanical polishing apparatus), wherein the polishing pad is moving in a first direction, comprising:

a) providing a conditioner assembly comprising a conditioning head assembly supporting a conditioning pad, a shaft assembly supporting the conditioning head assembly, and a linear torque bearing assembly slidably receiving the shaft assembly, wherein the linear torque bearing assembly is configured to operatively rotate the shaft assembly;

b) applying a compressive pressure by the conditioning pad to the polishing pad;

c) rotating the linear torque bearing assembly to operatively rotate the conditioning head; and d) oscillating the conditioner assembly in a second direction different from the first direction to condition the moving polishing pad.

In conditioning the polishing pad, the compressive pressure applied to the polishing pad can be adjusted without stopping the rotation of the linear torque bearing assembly. More specifically, the compressive pressure can be adjusted by increments equal to or greater than 0.1 psi. During the conditioning process, an exposed surface of the conditioning pad will remain generally parallel to and communicating with a plane defined by a surface of the polishing pad.

The present invention additionally provides a conditioner back support which respectively opposes the conditioner assembly such that the polishing belt supporting the polishing pad is disposed intermediate to the conditioner back support and the conditioner assembly. The conditioner back support comprises a frame assembly which adjustably supports a backing plate. The frame assembly comprises a positioning assembly which allows a user to adjust the position of the backing plate. The position of the backing plate can be adjusted such that a front surface of the backing plate is parallel to and disposed on or proximal to a plane defined by a backside of the polishing belt. As a result, when the conditioner assembly compresses against the polishing pad, the polishing pad does not significantly deflect. The conditioner back support further includes a polymeric compound disposed on the front surface of the backing plate for reducing the frictional force between the backing plate and the polishing belt.

The present invention also broadly provides a method for conditioning a moving polishing pad of a polishing apparatus (e.g., a chemical mechanical polishing apparatus), wherein the polishing pad moves in a first direction, comprising:

a) providing a conditioner assembly;

b) providing a back support assembly having a backing plate opposing the conditioner assembly, wherein the polishing pad is positioned intermediate to the back support assembly and the conditioner assembly;

c) compressing conditioner assembly against the polishing pad without any essential deflection in the polishing pad; and d) conditioning the polishing pad.

These features together with various ancillary advantages which will become apparent to those skilled in the art as the following description proceeds, are attained by these novel conditioning devices and methods of using the same, the preferred embodiments thereof shown with reference to the accompanying drawings, by way of example only, wherein:

BRIEF DESCRIPTION OF THE DRAWINGS

FIG. 1, moreover, illustrates a motor assembly for rotatably driving the linear to the bearing assembly;

FIG. 6B illustrates the directional flow of the slurry against and off the flow director when the conditioning head is rotatably compressed against the polishing pad;

FIG. 6C illustrates the directional flow of the slurry against and off the flow director when the conditioning head is rotatably compressed against the polishing pad;

DESCRIPTION OF THE PREFERRED EMBODIMENTS

Figure 1:
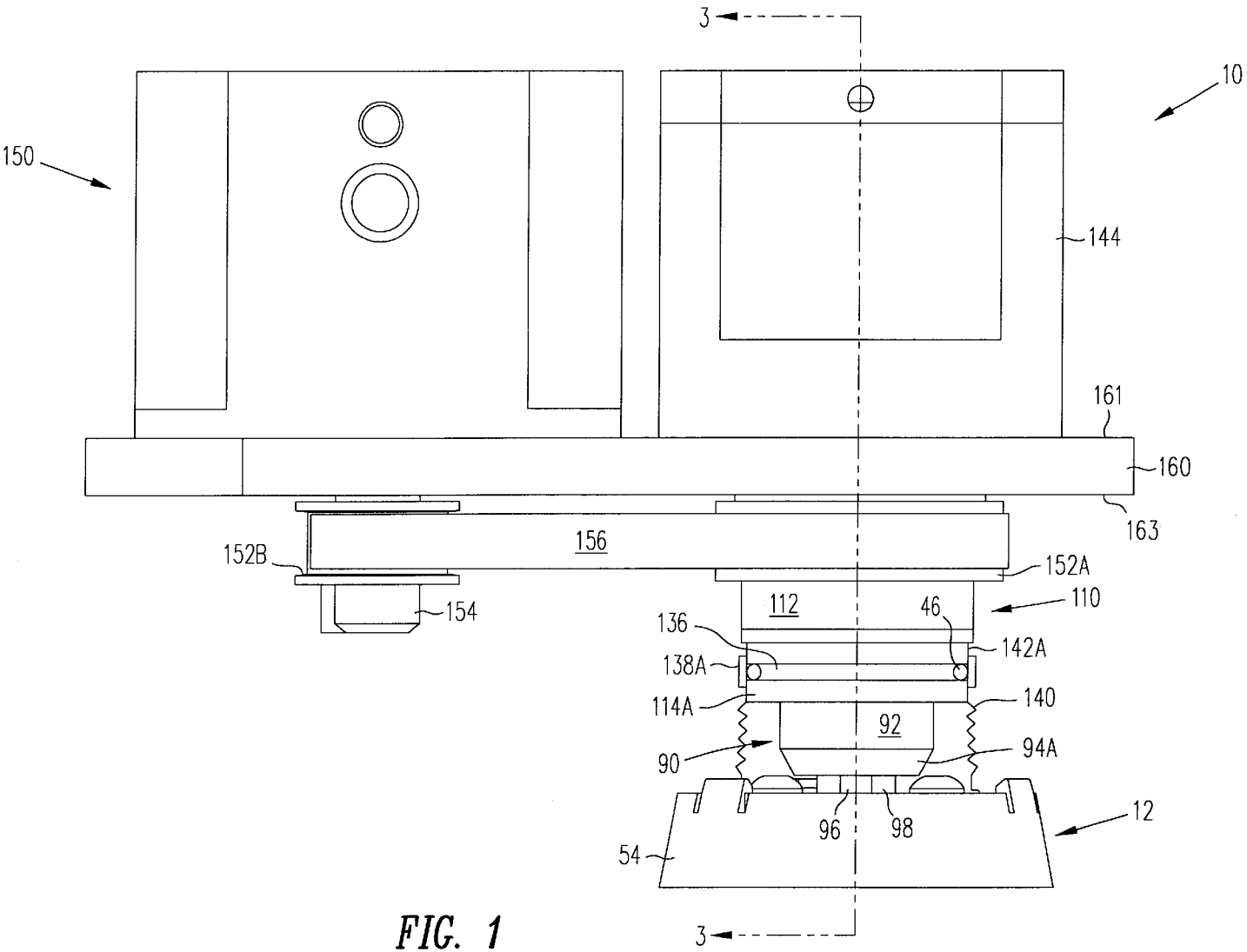
FIG. 1 is a top plan view of a conditioner assembly, in accordance with the present invention, having a conditioning head coupled to a shaft, a linear torque bearing assembly slidably engaged to the shaft for operatively rotating the shaft, a bellows coupled to the linear bearing torque assembly and the conditioning head, and a bearing housing disposed over the linear torque bearing assembly and engaged to a support plate.

Referring in detail now to the drawings wherein similar parts of the present invention are represented by like reference numerals, there is seen in FIGS. 1–25 an embodiment of the conditioner assembly, generally illustrated as 10, in accordance with the present invention. The conditioner assembly 10 may be used with any polishing apparatus, such as a linear 300 or a planar 400 chemical mechanical polishing device (see FIGS. 50–53 for schematic illustrations of the linear 300 and planar 400 polishing devices). The linear chemical mechanical polishing apparatus 300 may, for example, be of the type disclosed in application Ser. No. 08/964,930, filed Nov. 5, 1997, to Anderson et al., entitled "Modular Wafer Polishing Apparatus and Method," now U.S. Pat. No. 5,957,764 issued on Sep. 28, 1999, assigned to the assignees of the present invention, and fully incorporated herein by reference in its entirety as is repeated verbatim immediately hereinafter.

Figure 5:
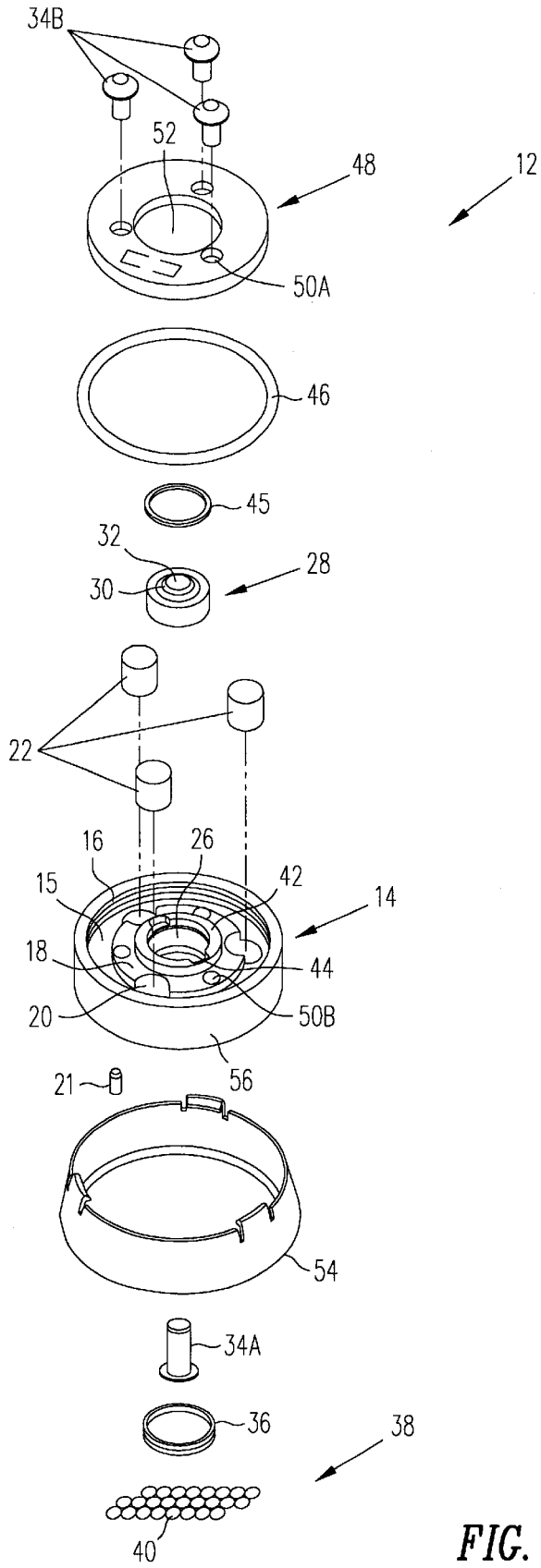
FIG. 5 is an exploded view of the conditioning head of the conditioner assembly of the present invention.

The conditioner assembly 10 comprises a conditioning head 12. As best illustrated in FIG. 5, the conditioning head 12 includes a disc member 14 having a structure generally defining an annular concavity 15 formed on a backside 16 of the disc member 14. The annular concavity 15 terminates in a circular ledge portion 18. A plurality of vias 20 are formed in the annular concavity 15 such that a portion of the vias 20 communicates with the circular ledge portion 18. Magnets 22 are disposed in the vias 20 for magnetically engaging a conditioning pad 38 to an outer face 24 of the disc member 14. The conditioning pad 38 may be manufactured from any suitable material, such as nickel plated steel plate impregnated with diamond, chemical vapor diamond plate bonded to a metallic substrate, etc. which is conventionally employed to condition a polishing pad 304 of a polishing belt 302. The conditioning pad 38, e.g., the diamond plate, may be structurally generally defined by a plurality of inner-connected cells 40, and therefore, a pin member 21 may be engaged to the outer face 24 to further prevent the conditioning pad 38 from rotating with respect to the conditioning head 12 by capturing one of the cells 40 (see FIG. 23). The disc member 14 includes an inner annular void 26 which penetrates through the disc member 14 and communicates with the outer face 24. The inner annular void 26 is configured to house a gimbal assembly 28, such as a spherical bearing. The ball portion 30 of the spherical bearing 28 has a bore 32 for receiving a screw 34A. The screw 34A engages a shaft 90 of the conditioner assembly 10 to the gimbal assembly 28 (as will be described in further detail below). The spherical bearing 28 allows the conditioning head 12, to gimbal with respect to the shaft 90. The gimbaling effect allows the exposed surface 39 of the conditioning pad 38, during the conditioning process, to be generally parallel to and communicating with a plane defined by a surface 303 of said polishing pad 304. A end cap 36 covers the inner annular void 26 on the outer face 24 side of the disc member 14 to prevent fluids, such as slurry, from penetrating into the conditioning head 12 through the inner annular void 26. A shaft receiving ring 42, encircling the inner annular void 26, is coupled to the circular ledge portion 18. The shaft receiving ring 42 has a pair of ears 44 which respectively register with shaft lugs 98 of the shaft 90, as will be described in detail below. The ears 44 of the shaft receiving ring 42 allow the shaft 90 to transfer a torque to the conditioning head 12 while still allowing the conditioning head 12 to gimbal with respect to the shaft 90. Further structure of the conditioning head 12 includes a lid 48 having recesses 50A for receiving screws 34B which capture recesses 50B of the ledge portion 18. The lid 48 includes a lid opening 52 having a diameter slightly larger than an outer diameter of the shaft receiving ring 42 such that the lid opening 52 fittingly encircles the shaft receiving ring 42. A ring member 45 secures the gimbal assembly to the conditioner head 12. An "O" ring seal 46 may be disposed between the lid 48 and the backside 16 of the disc member 14 for sealing the conditioning head 12. The disc member 14 may be manufactured from any suitable material, including polymers, metals, alloys, etc.

Figure 6A:
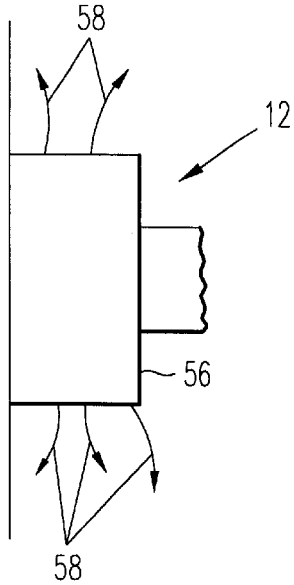
FIG. 6A is a side schematic view of the conditioning head of the present invention compressed against a polishing pad, illustrating the directional flow of a slurry caused by the rotation of the conditioning head.
Figure 6B:
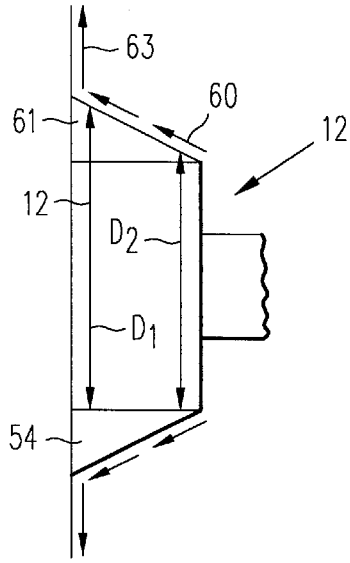
FIG. 6B is a side schematic view of the conditioning head of the present invention having a flow director engaged thereto, the flow director comprises an outer diameter larger than the inner diameter.
Figure 6C:
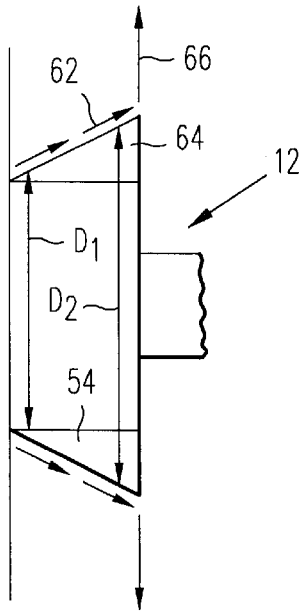
FIG. 6C is a side schematic view of the conditioning head of the present invention having a flow director engaged thereto, the flow director comprises an outer diameter smaller than the inner diameter.

The conditioning head 12 may also include a flow director 54 configured to guide a directional flow of the slurry employed in the conditioning process. The flow director 54 connectably engages to the conditioning head 12 and circumscribes an outer wall 56 of the disc member 14. Referring to FIG. 6A, during the conditioning process, as will be described below, the slurry circulates against the outer wall 56 of the conditioning head 12. The surface tension of the slurry causes the slurry to be collected on the surface of the outer wall 56. The rotation of the conditioning head 12 causes the collected slurry to propel off the outer wall 56 in an erratic, non-uniform direction, as illustrated by arrows 58. Engaging the flow director 54 to the conditioning head 12 allows the slurry to propel off the conditioning head 12 in an uniform direction. Referring to FIG. 6B, in one implementation, the flow director 54 comprises an outer ring diameter $D_1$ larger than an inner ring diameter $D_2$. The centripetal force of the rotating conditioning head 12 causes the slurry that is collected on the surface of the flow director 54 to move in the direction of arrow 60. The build-up of the slurry, in an area illustrated by numeral 61, overcomes the surface tension of the slurry. As a result, the slurry propels off the surface of the flow director 54 in the direction of arrow 63. Alternatively, Referring to FIG. 6C, the outer diameter $D_1$ of the flow director 54 may be smaller than the inner diameter $D_2$. The centripetal force of the rotating conditioning head 12 caused the slurry that is collected on the surface of the flow director 54 to move in the direction of arrow 62. The build-up of the slurry, in an area illustrated by numeral 64, overcomes the surface tension of the slurry. As a result, the slurry propels off the surface of the flow director 54 in the direction of arrow 66. The flow director 54 may be manufactured from any suitable material, including metals, alloys, plastics, polymers, etc.

Figure 7A:
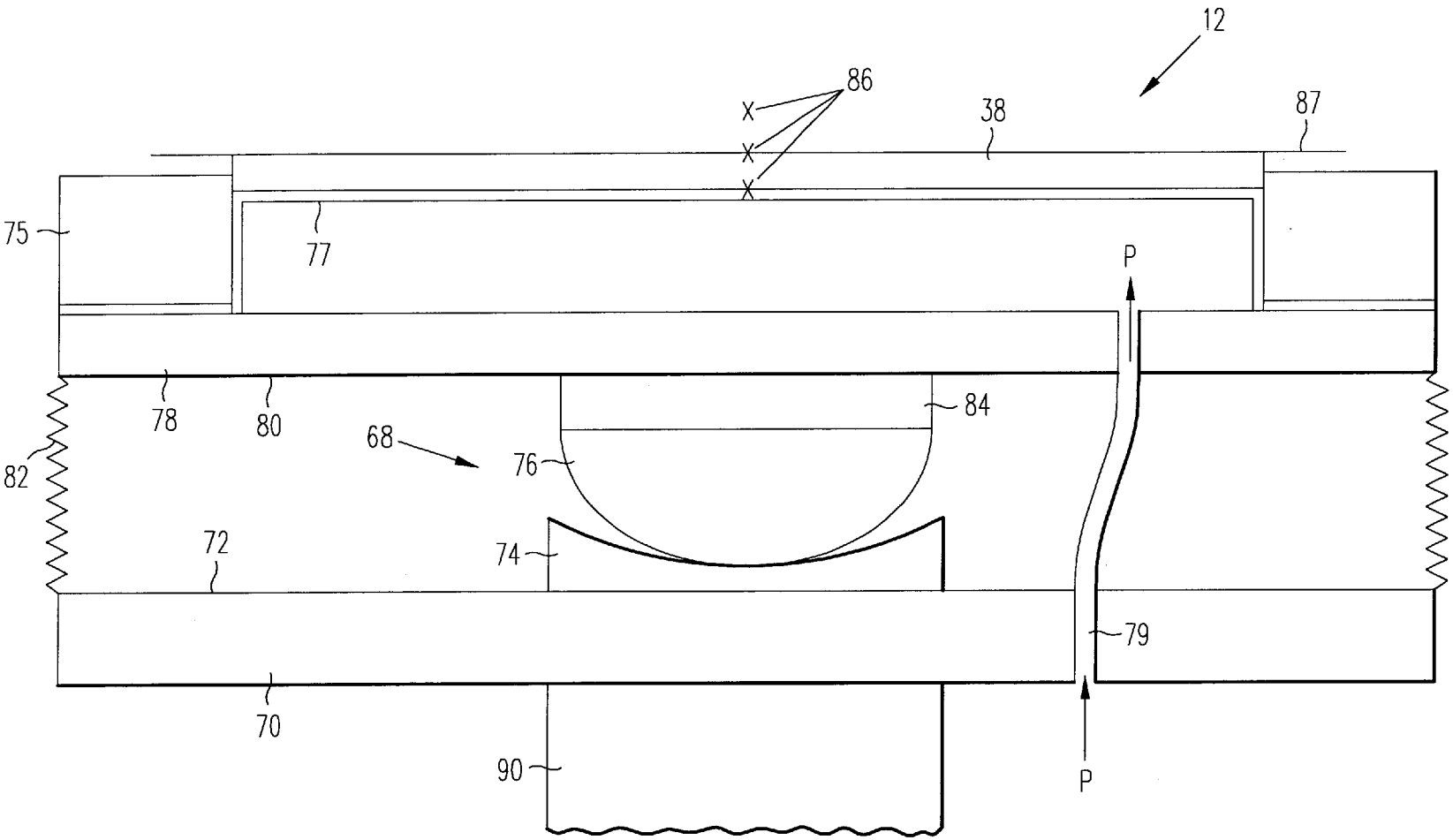
FIG. 7A is a side cross sectional view of another embodiment of the conditioning head for the conditioner assembly of the present invention, illustrating a driving plate having a first hemisphere of a gimbal, a subcarrier having a second hemisphere of the gimbal, a bellows biasedly coupling the driving plate to the subcarrier, a retaining ring coupled to the subcarrier, a bladder member encircled by the retaining ring, and a conditioning pad supported by the bladder member; a virtual center of the conditioning head is positioned on or proximal to a plane defined by the exposed surface of the conditioning pad.

In another embodiment of the conditioning head 12, as illustrated in FIG. 7A, the shaft 90 is coupled to a driving plate 70. The conditioning head 12 includes a first hemisphere 74 of a gimbal assembly 68 connected to a front side 72 of the driving plate 70. A subcarrier 78 is biasedly coupled to the driving plate with a bellows 82. A second hemisphere 76 is engaged to a backside 80 of the subcarrier 78. The second hemisphere 76 is configured to respectively register with the first hemisphere 74 such that the conditioning pad 38 can gimbal with respect to the shaft 90. A spacer member 84 may be sandwiched between the backside 80 of the subcarrier 78 and the second hemisphere 76 so that the second hemisphere 76 is spaced from or positioned at a distance away from the backside 80 of the subcarrier 78. A retaining ring 75 is engaged to the subcarrier 78. The retaining ring 75 may be manufactured from any suitable material, including plastics, polymers, metals, alloys, etc. A bladder member 77 is encircled by the retaining ring 75 and is supported by the subcarrier 78. The bladder member 77 may be manufactured from any suitable material, including polymers, metals, alloys, etc. such as ethylene-propylene-diene-methylene (EPDM). The bladder member 77 supports the conditioning pad 38. The conditioning pad 38 may be engaged to the bladder member 77 with an adhesive material, by vulcanization, or by magnetization, as is well understood by persons skilled in the art. An inlet means 79 is provided in the conditioning head 12 to provide a pressure P to the bladder member 77.

Figure 7B:
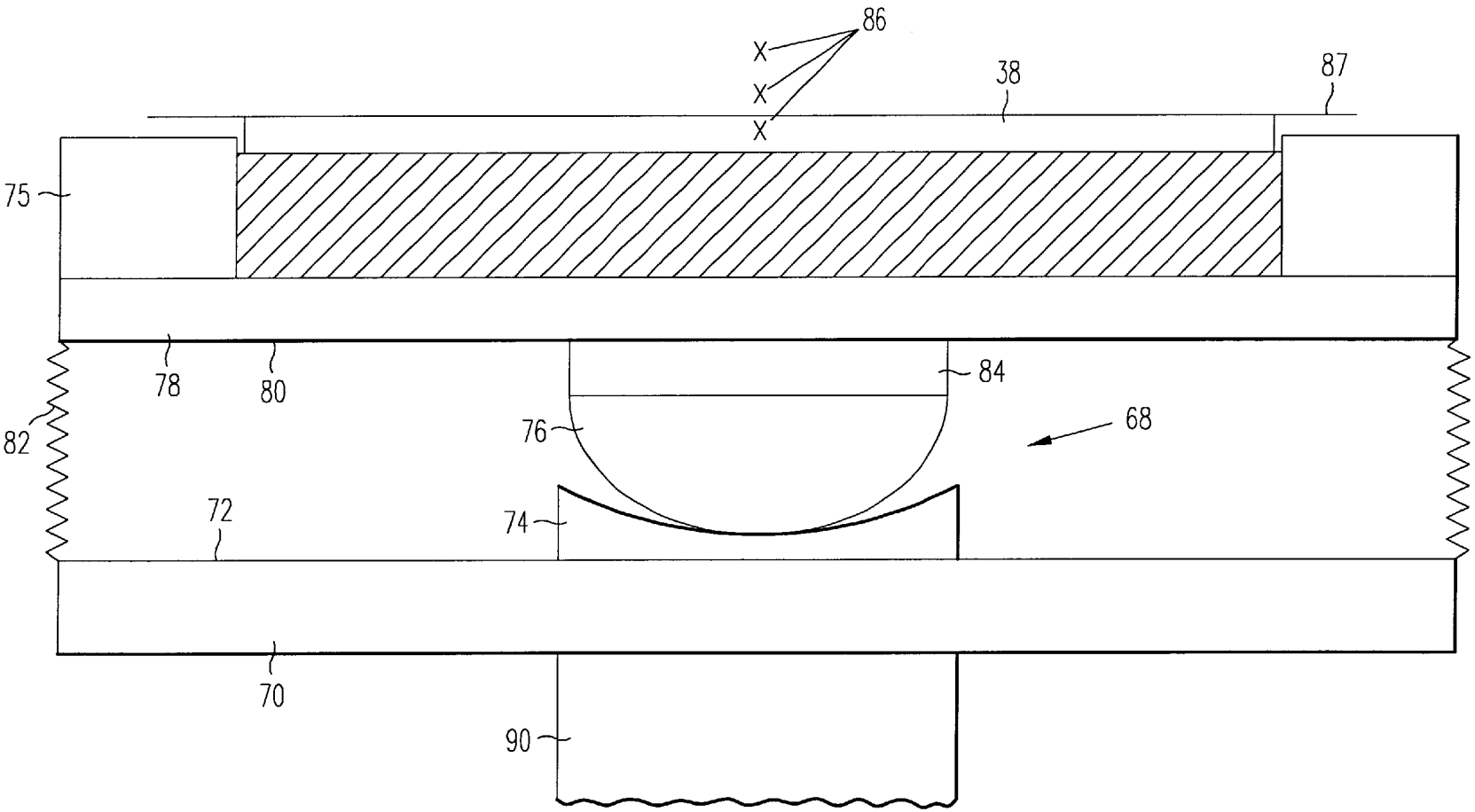
FIG. 7B is a side cross sectional view of another implementation of the embodiment of the conditioning head of FIG. 7A, illustrating a chuck employed in lieu of the bladder member.

In another implementation, the chuck 81 may be used in lieu of the bladder member 77, as illustrated in FIG. 7B. The chuck 81 is configured to support the conditioning pad 38. The chuck 81 may be manufactured from any suitable material including plastics, metals, etc.

Figure 8:
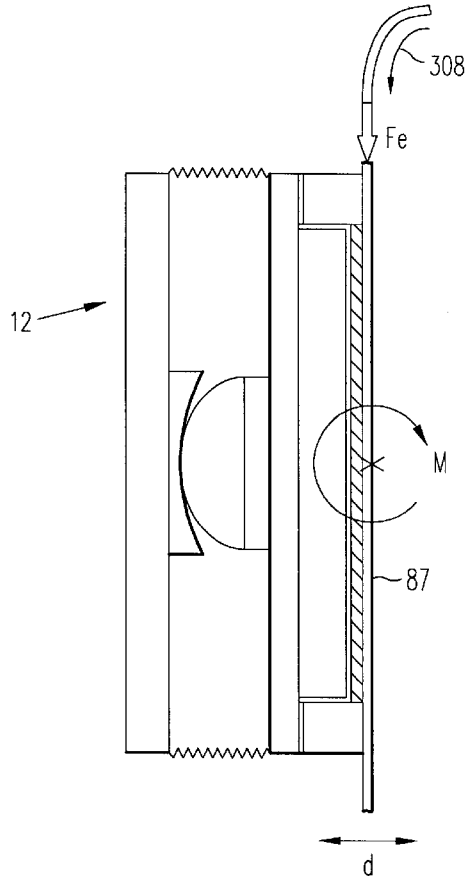
FIG. 8 is a side cross sectional view of the conditioning head of FIG. 7 positioned against the polishing pad of a linear chemical mechanical polishing belt, illustrating the force applied to the conditioning pad by the polishing pad; the moment about the virtual center is negligible.
Figure 9:
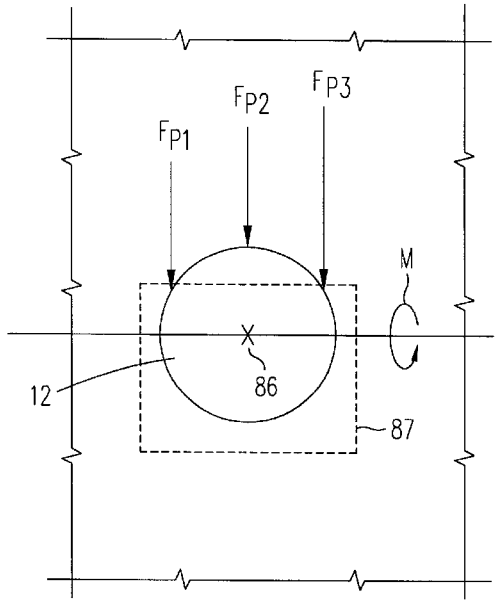
FIG. 9 is a schematic view of the conditioning head of FIG. 7 positioned against the polishing pad, illustrating the forces applied to the conditioner pad by the polishing pad.
Figure 10:
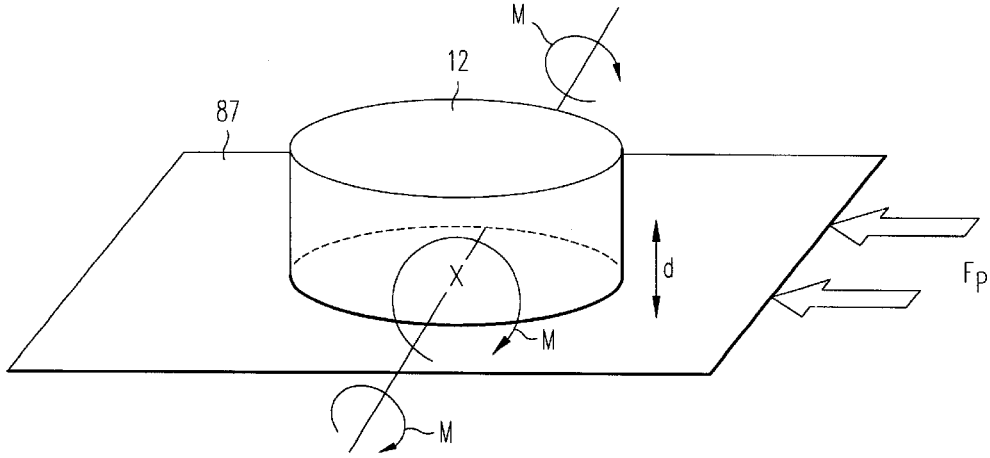
FIG. 10 is another schematic view of the conditioning head of FIG. 7, illustrating the applied forces and the moment about the virtual center.

A virtual center of the conditioning head 12, as illustrated by numeral 86, is located in the center of the conditioning head 12 and is positioned generally on or proximal to a plane 87 defined by the exposed surface 39 of the conditioning pad 38. As illustrated by FIGS. 8–10, during the conditioning process, the polishing pad 304 applies a frictional force F against the conditioning pad 38. As a result, various moments are applied to the virtual center 86. However, because the virtual center is positioned on proximal to the plane 87, the summation of the moment illustrated as M, is negligible. The equations are as follows, wherein d is a distance between the virtual center 86 and the vectors defining the force F:

$$\Sigma M = F_{p1}d_1 + F_{p2}d_2 + F_{pn}d_n$$

wherein $$d_1,\ d_2\ \&\ d_n = 0$$

$$\Sigma M = F_{p1}0 + F_{p2}0 + F_{pn}0$$

$$\Sigma M = 0$$

Because the moment M about the virtual center 86 is 0, during the conditioning process, the exposed surface 39 of the conditioning pad 38 (i.e., plane 87) remains parallel to and generally in contact with a plane defined by the surface 303 of the conditioning pad 304.

Figure 11:
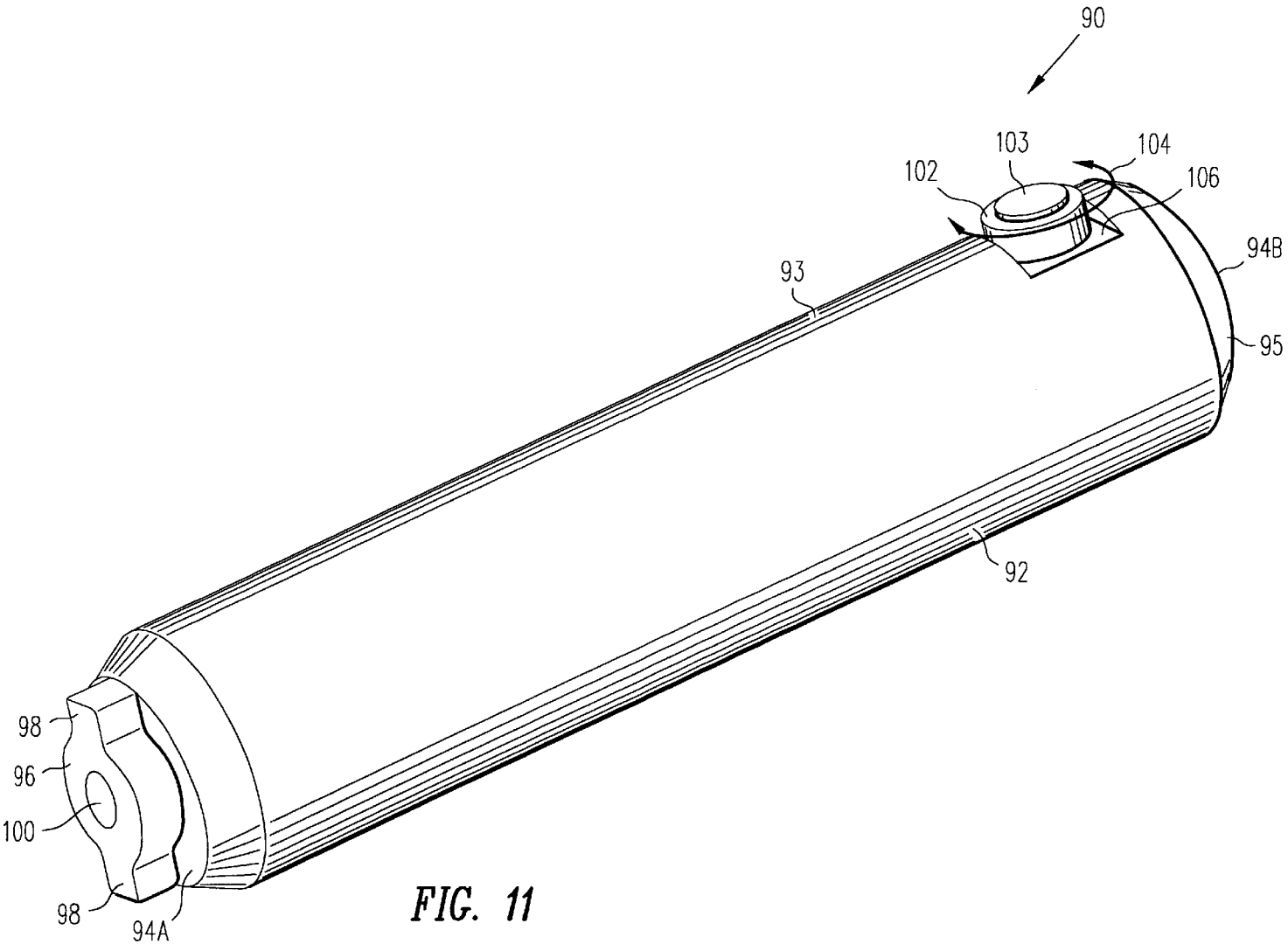
FIG. 11 is a perspective view of the shaft for the conditioner assembly of the present invention, clearly illustrating the shaft being structurally generally defined by a rod body having opposing ends, a circular boss, having lugs integrally extending therefrom, protruding from the first end, and a shaft keyway bearing assembly rotatably supported by the rod body.
Figure 12:
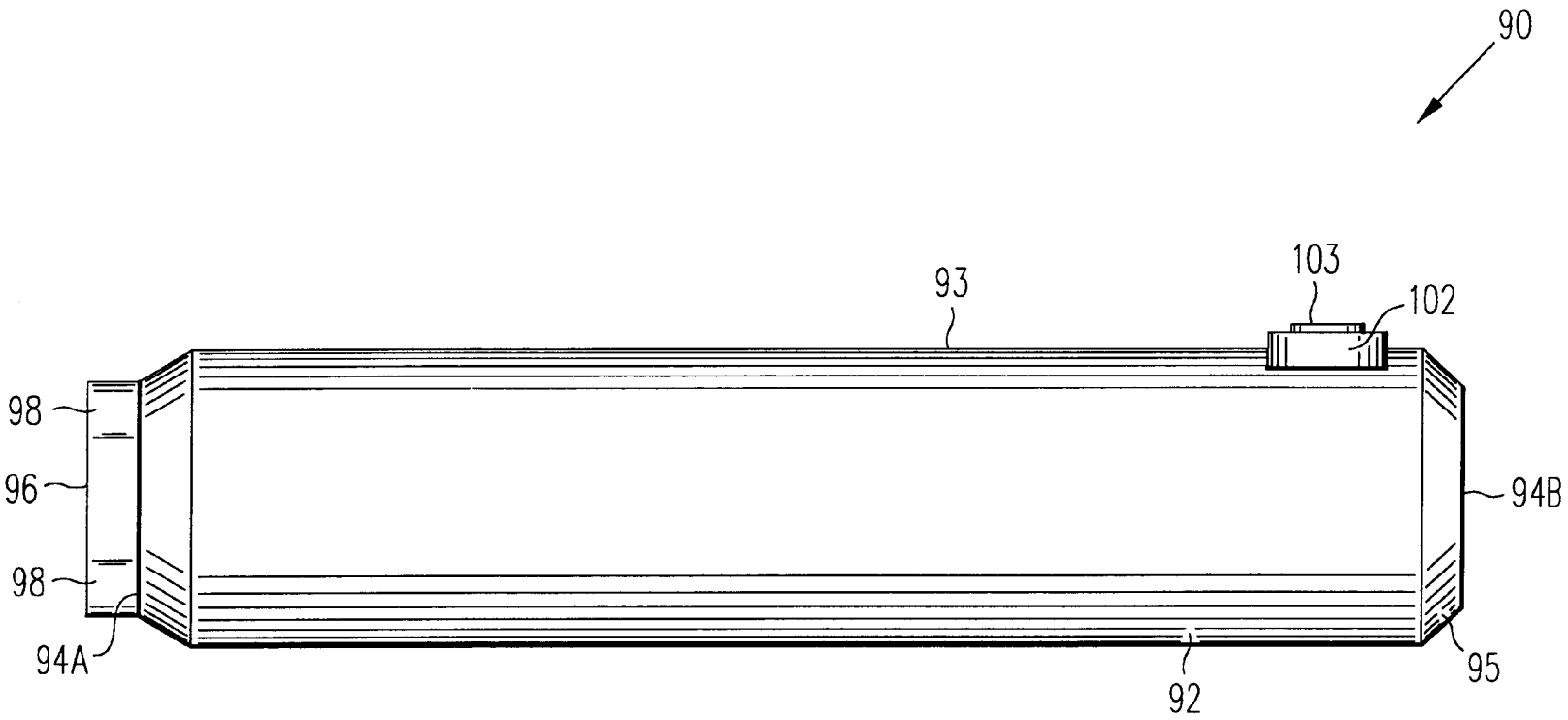
FIG. 12 is a side elevational view of the shaft for the conditioner assembly of the present invention, illustrating the rod body rotatably supporting the shaft keyway bearing assembly such that the upper surface of the shaft keyway bearing assembly is spaced from or positioned at a distance away from an outer surface of the rod body.
Figure 13:
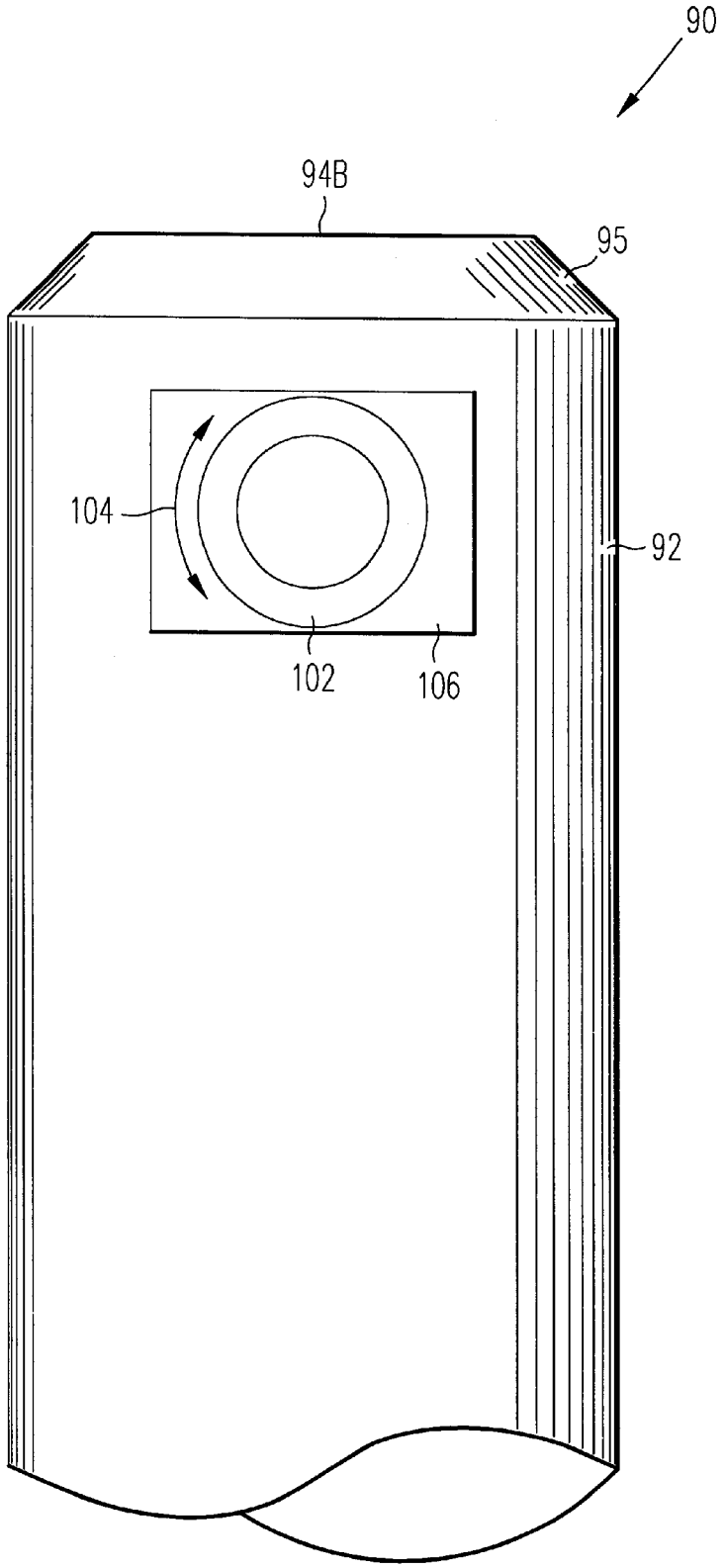
FIG. 13 is a partial top plan view of the shaft having the shaft keyway bearing assembly.

Referring now to FIGS. 11–13, the shaft 90 is structurally generally defined by a rod body 92 having opposing ends 94A and 94B. A circular boss 96, having the shaft lugs 98 integrally extending therefrom, protrudes from the first end 94A. A shaft recess 100, formed in the boss 96, captures the screw 34A for coupling the shaft 90 to the gimbal assembly 28 (e.g., the spherical bearing). As discussed above, with respect to the description of the first embodiment of the conditioning head 12, the shaft lugs 98 are configured to respectively register with the ears 44 of the shaft receiving ring 42. The registration of the shaft lugs 98 with the ears 44 allows the shaft 90 to apply a torque to the conditioning head 12. A space 91 is disposed between the shaft lugs 98 and the ears 44 so as to allow the conditioning head 12 to gimbal with respect to the shaft 90. The second end 94A is generally defined by tapered edge 95. The tapered edge 95 allows a vacuumed pressure, applied through a bearing housing 144, to compress the second end 94A against the bearing housing 144, as will be described in detail below.

A shaft keyway bearing assembly 102 is rotatably supported by the rod body 92, such that an upper surface 103 of the shaft keyway bearing assembly 102 is spaced from or positioned at a distance away from an outer surface 93 of the rod body 92. The shaft keyway bearing assembly 102 rotates about an axis perpendicular to a longitudinal axis of the shaft 90, as is illustrated by arrow 104. As best illustrated in FIGS. 12 and 13, the shaft keyway bearing assembly 102 may be disposed in a flat cavity 106 formed in the rod body 92. The shaft 90 may be manufactured from any suitable material, including metals and alloys such as stainless steel.

The conditioner assembly 10 additionally comprises a linear torque bearing assembly 110 configured to slidably receive and operatively rotate shaft 90. The linear torque bearing assembly 110 and the shaft 90, in effect, form a piston assembly. The linear torque bearing assembly 110 comprises a generally cylindrical, hollow casing 112 having opposing first and second open ends 114A and 114B (see FIGS. 14 and 15). A bearing lining 115 is disposed on an inner surface of the casing 112. The bearing lining 115 reduces the frictional force between an the outer surface 93 of the rod body 92 and the inner surface of the casing 112. The bearing lining may be manufactured from any suitable bearing liner material. The casing 112, including the bearing lining 115, has an inner diameter slightly greater than the outer diameter of the shaft 90. Therefore a clearance 111 exists between the outer surface 93 of the rod body 92 and the inner surface of the casing 112, including the bearing lining 115. For example, the outer diameter of shaft 90 may be about 0.001 inches to about 0.0025 inches smaller than the inner diameter of the casing 112, including the bearing lining 115. The clearance 111, in effect, acts as an air bearing, as is well understood by persons skilled in the art, which further reduces the frictional force between the outer surface 93 of the rod body 92 and the inner surface of the casing 112, including the bearing lining 115.

A first 116 and second 118 case bearings circumscribe and are rotatably engaged to the casing 112. The outer diameter of the first case bearing 116 is larger than the outer diameter of the second case bearing 118. A slot 122, formed in an inner annular region 120 of the casing 112, extends from the second open end 114B towards the first open end 114A. The slot 122 is structurally defined by a pair of opposing side walls 124 having a common end wall 126. The shaft 90 can be slidably inserted through the second open end 114B wherein the protruding shaft keyway bearing assembly 102 registers with the slot 122. The slidable extension of the shaft 90 through the case 112 and out of the first open end 114A is terminated by the meeting of the shaft keyway bearing assembly 102 and the end wall 126 (see FIGS. 4 and 18). The rotation of the linear torque bearing assembly 110, as illustrated by arrow 8, causes the side walls 124 to apply a force $F_T$ to the shaft keyway bearing assembly 102, thus rotating the shaft 90. The application of the force $F_T$ from the side wall 124 to the shaft keyway bearing assembly 102 does not prevent the shaft 90 from slidably extending and retracting through the casing 112 and the first open end 114A. The shaft keyway bearing assembly 102 can rotate against the side wall 124, as indicated by the rotational arrow 104, during the application of the force $F_T$ (see FIGS. 17 and 18), thus allowing the casing 112 to slidably receive and operatively rotate shaft 90.

Figure 3:
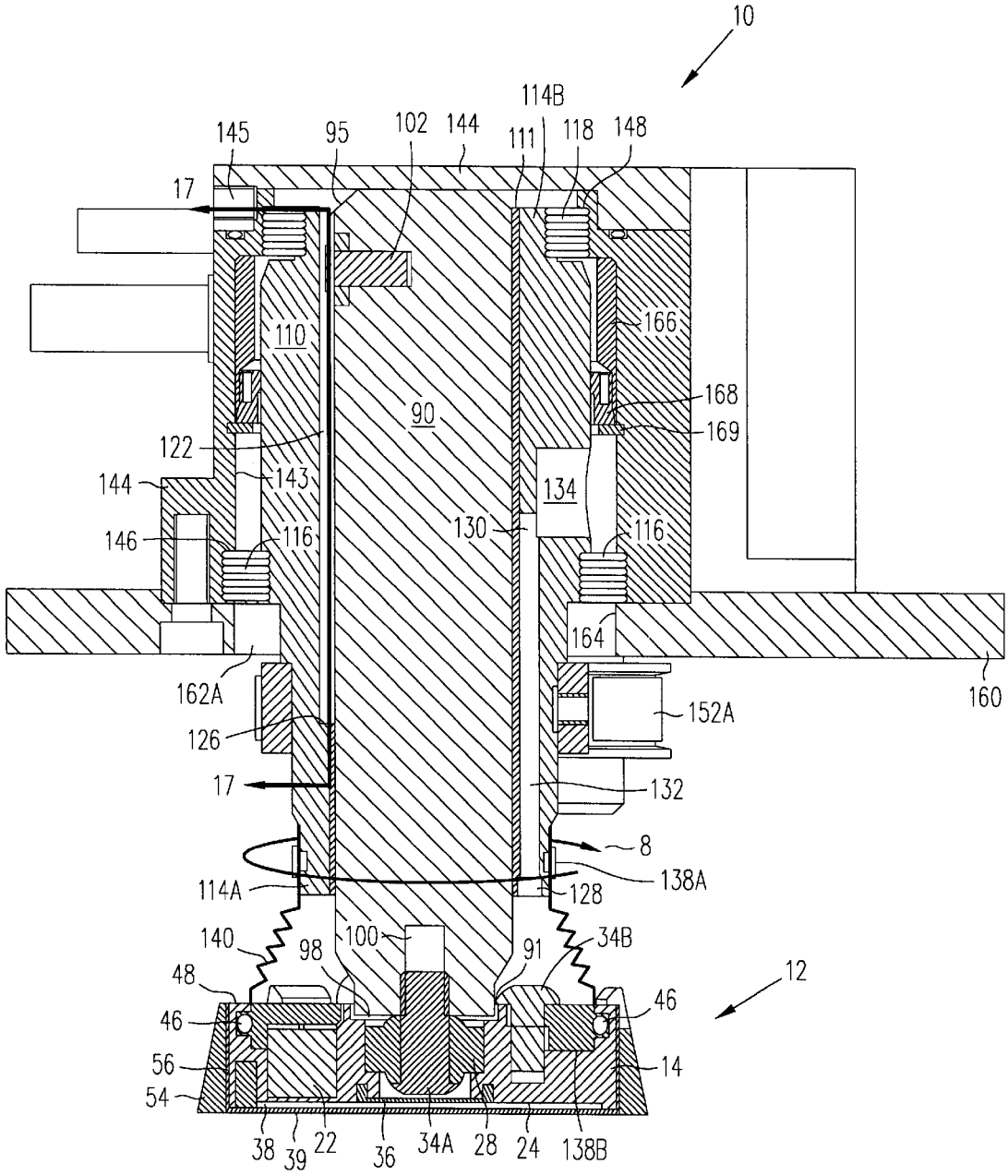
FIG. 3 is a side cross sectional view of the conditioner assembly of the present invention taken in the direction of the arrow and along the plane of line 3—3 of FIG. 1, illustrating the shaft having a shaft keyway bearing assembly, the linear torque bearing assembly having a slot which registers with the shaft keyway bearing assembly, a purge port disposed in a generally cylindrical hollow casing of the linear torque bearing assembly, and an outlet port communicating with the purge port.
Figure 4:
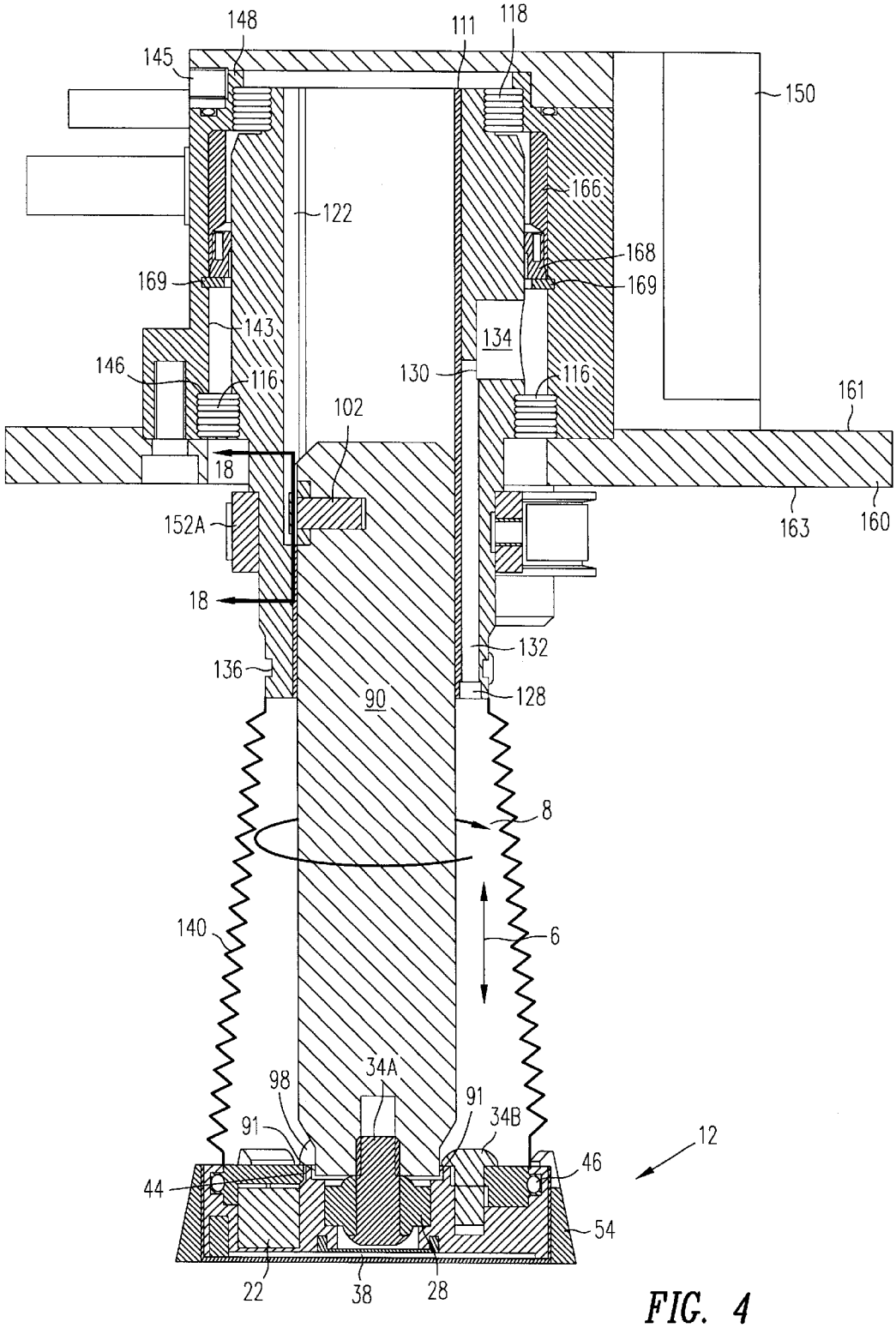
FIG. 4 is the side cross sectional view of the conditioner assembly as illustrated in FIG. 3 but for the extension of the shaft through the first open end of the linear torque bearing assembly; the extension of the shaft is terminated by the meeting of the shaft keyway bearing assembly with an end wall of the slot of the linear torque bearing assembly.
Figure 14:
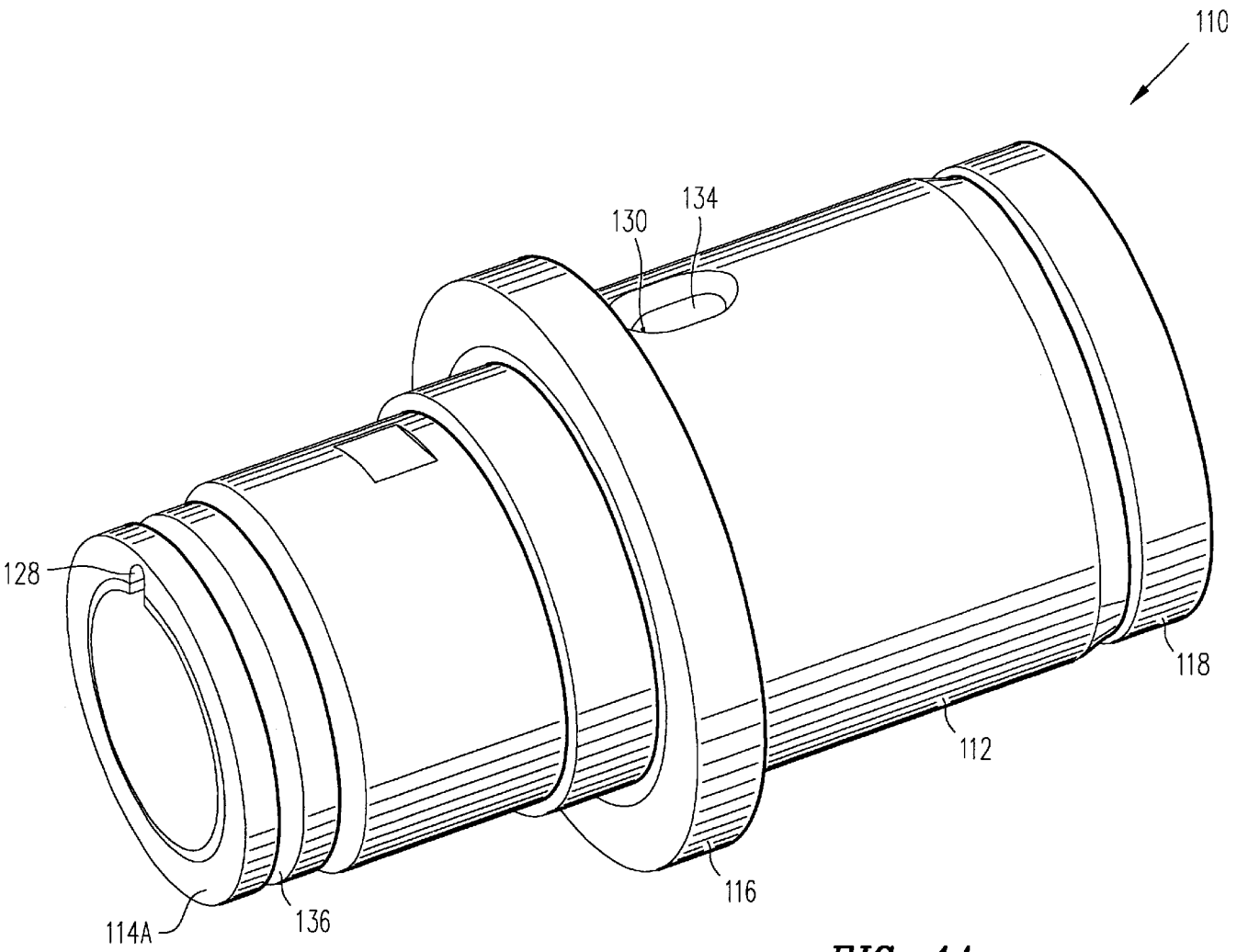
FIG. 14 is a perspective view of the linear torque bearing assembly generally defined by the cylindrical, hollow casing having the opposing open ends and the case bearings circumferentially engaged to the casing.
Figure 15:
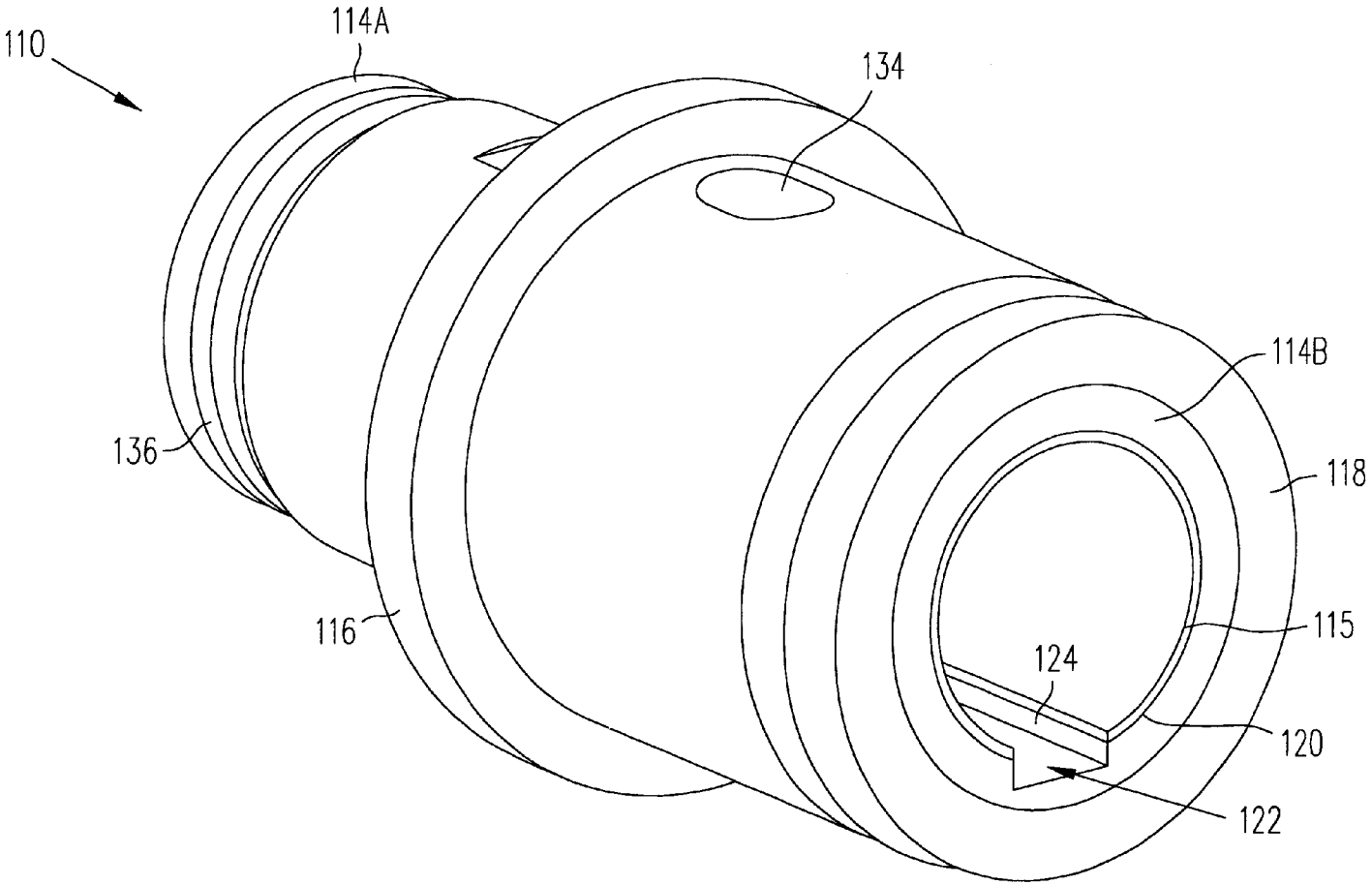
FIG. 15 is another perspective view of the linear torque bearing assembly, illustrating the slot formed in an inner annular region of the casing.
Figure 16:
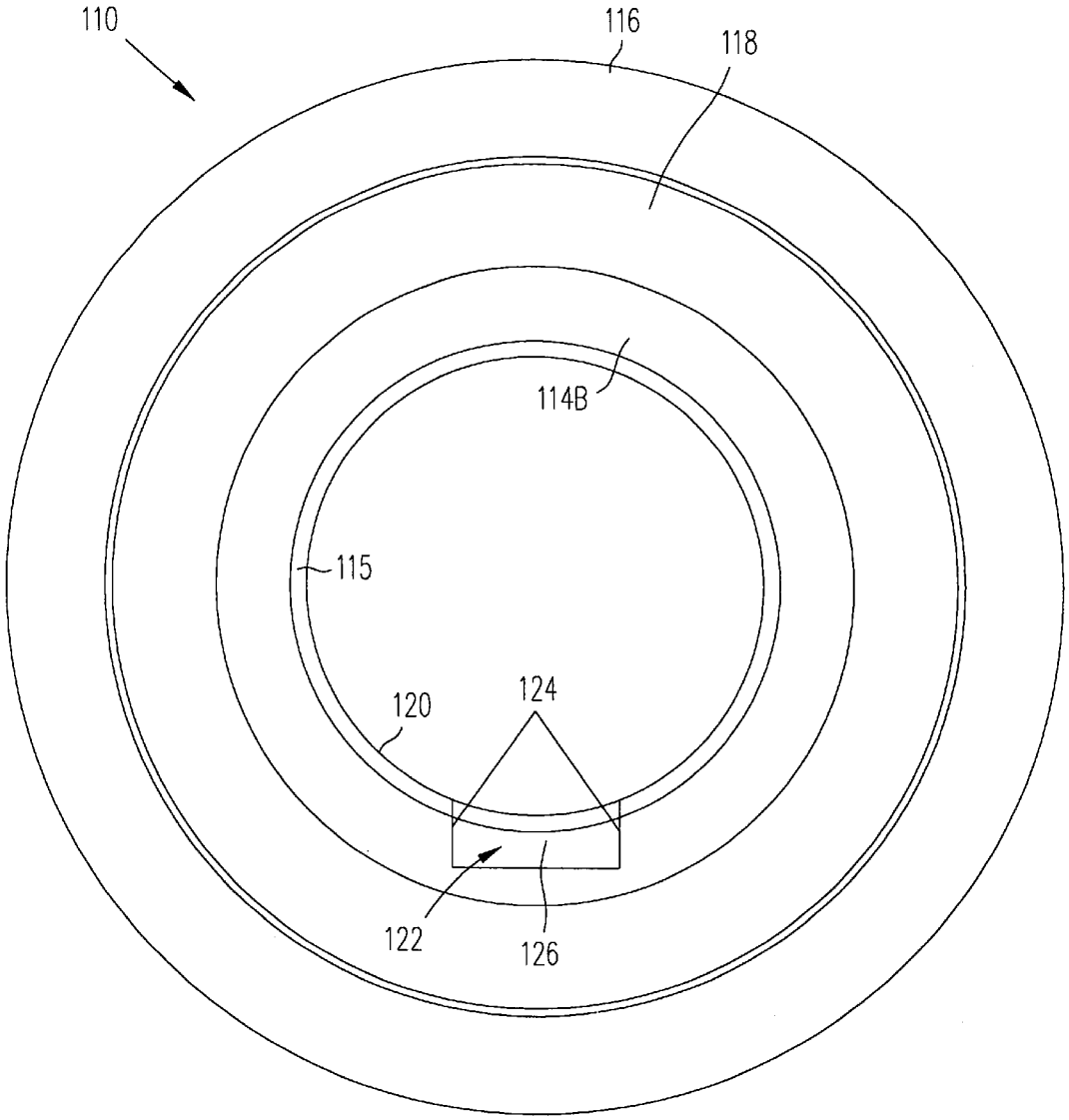
FIG. 16 is an end elevational view of the linear torque bearing assembly, clearly illustrating the slot extending from the second open end towards the first open end.
Figure 17:
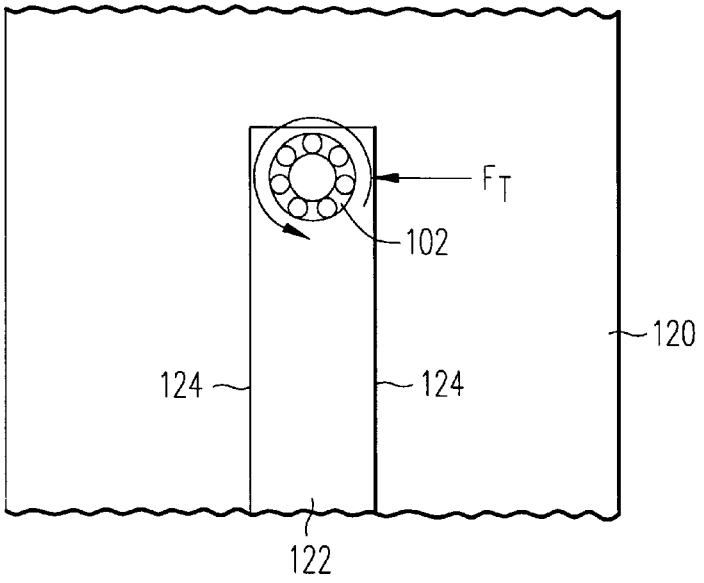
FIG. 17 is a cross sectional view of the conditioner assembly of the present invention taken in the direction of the arrows and along the plane of line 17—17 of FIG. 3, illustrating the shaft keyway bearing assembly respectively registering with the slot of the linear torque bearing assembly; a side wall of the slot can apply a force to the shaft keyway bearing assembly and thus rotating the shaft.
Figure 18:
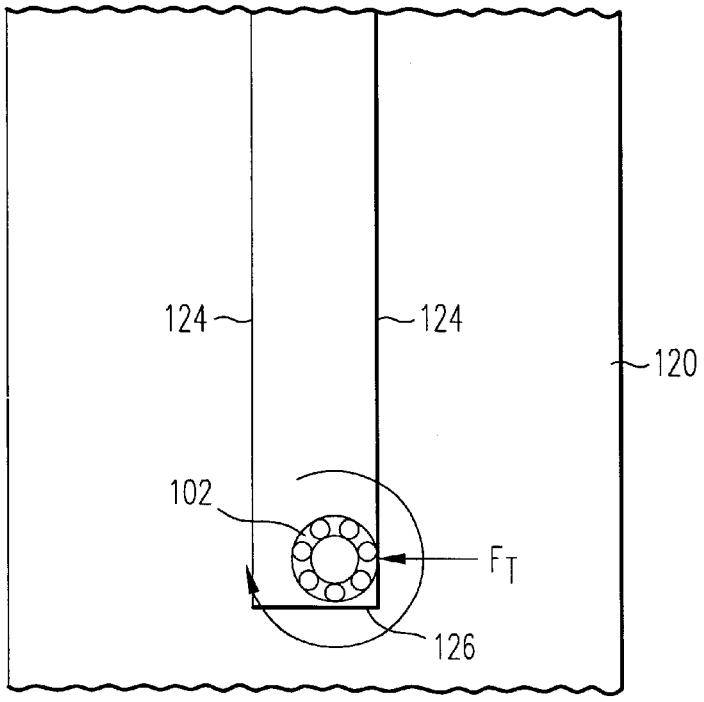
FIG. 18 is a cross sectional view of the conditioner assembly of the present invention taken in the direction of the arrows and along the plane of line 18—18 of FIG. 4, illustrating the shaft keyway bearing assembly respectively registering with the slot of the linear torque bearing assembly.
Figure 19:
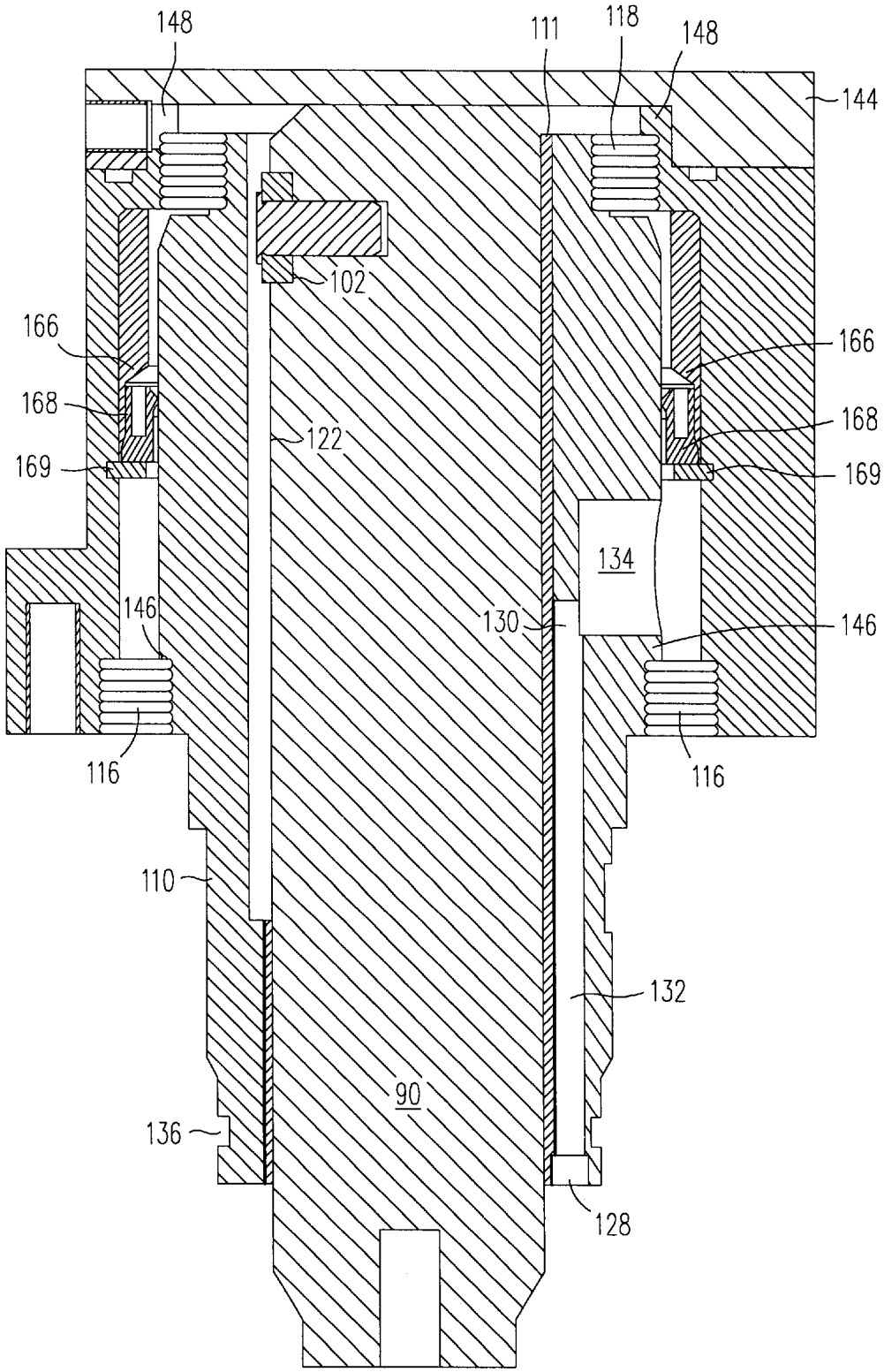
FIG. 19 is a side elevational view of the bearing housing disposed over the second open end of the linear torque bearing assembly, the bearing housing supports the case bearings thus allowing the casing to rotate with respect to the bearing housing.
Figure 20:
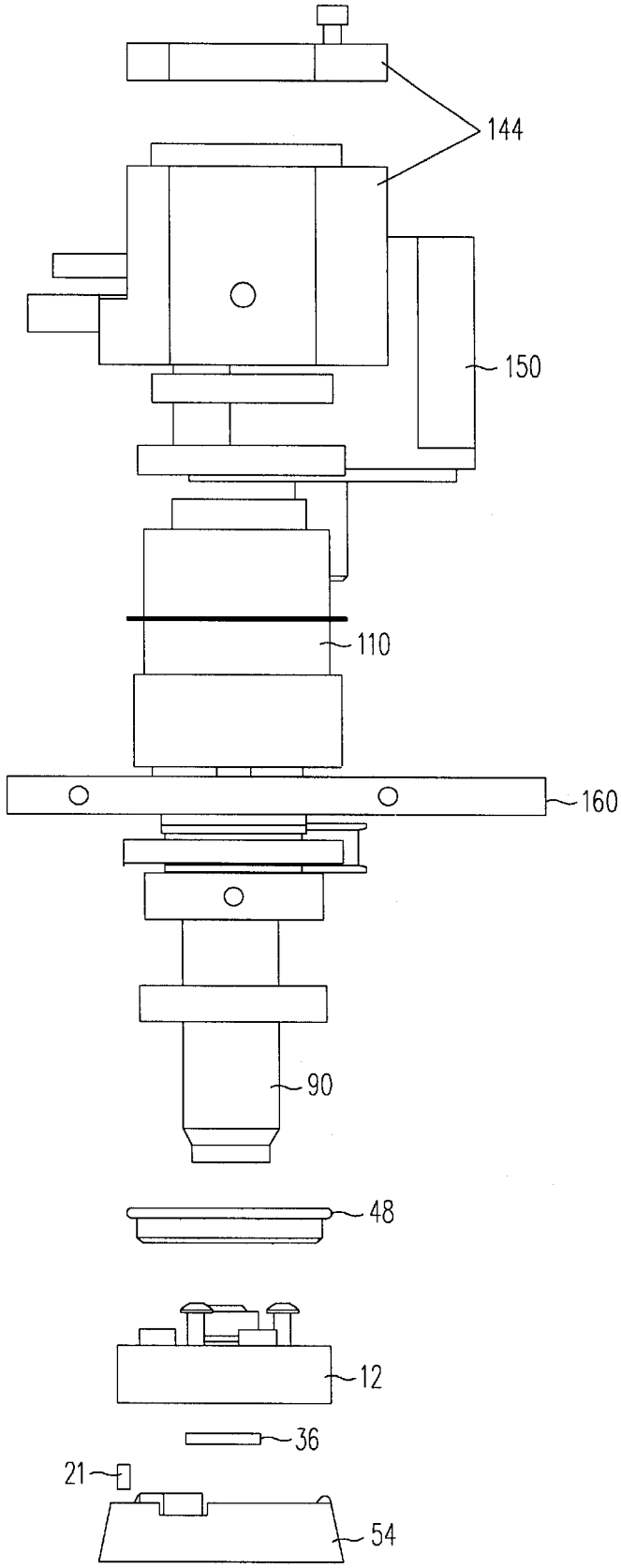
FIG. 20 is an exploded, side elevational view of the conditioner assembly of the present invention including the motor assembly.
Figure 21:
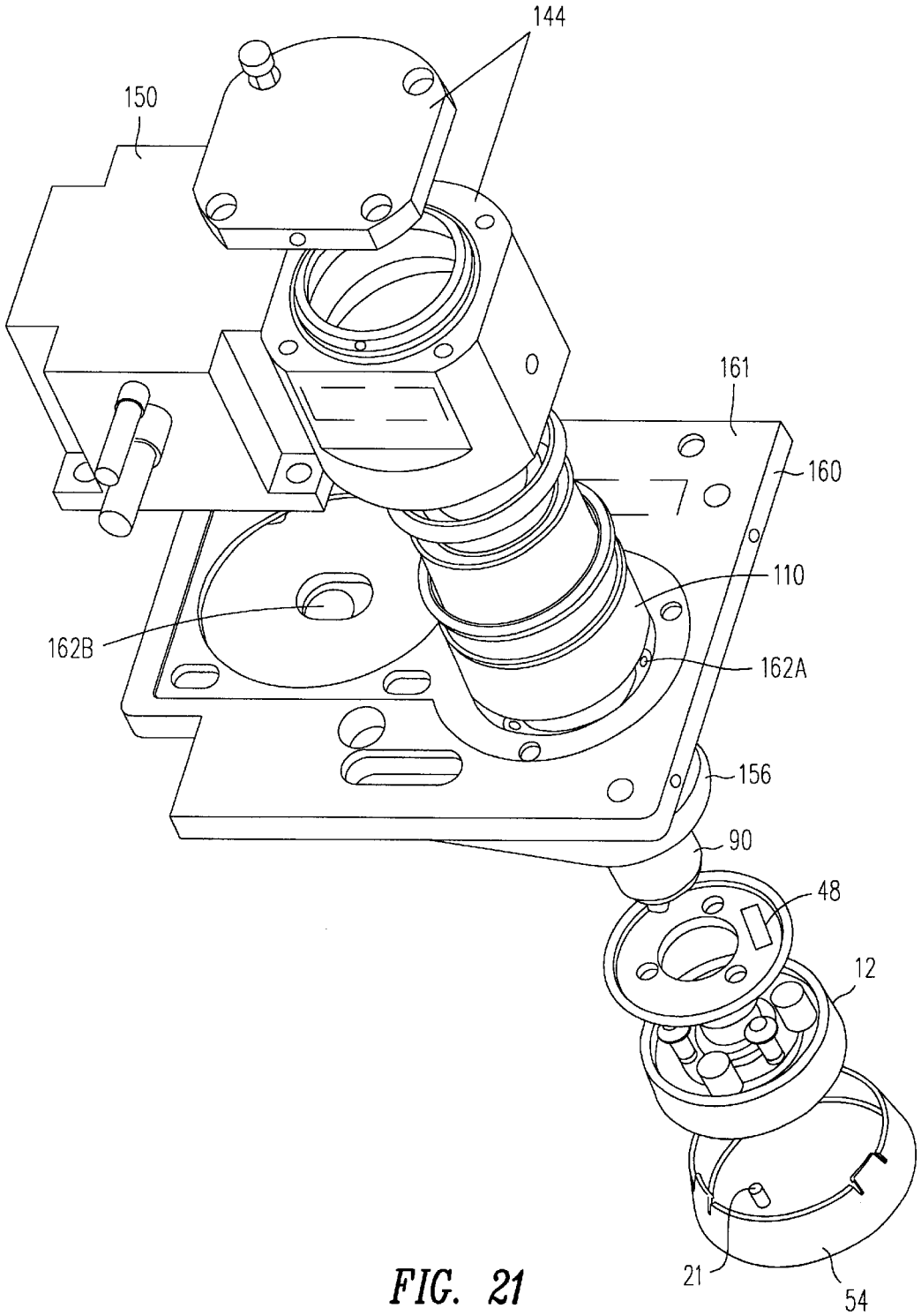
FIG. 21 is an exploded rear perspective view of the conditioner assembly of the present invention including the motor assembly.
Figure 22:
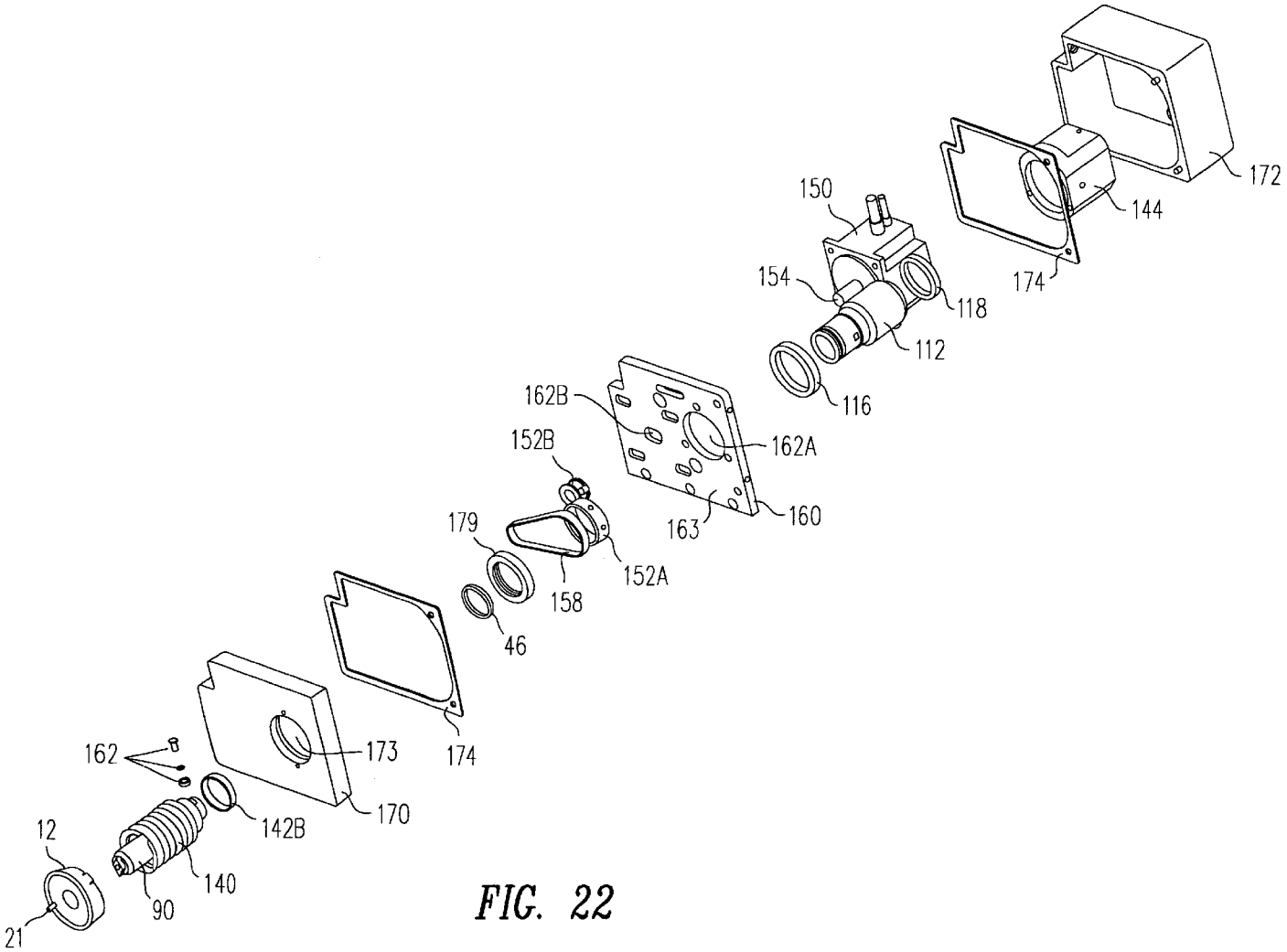
FIG. 22 is an exploded, perspective view of the conditioner assembly of the present invention, including the motor assembly.
Figure 23:
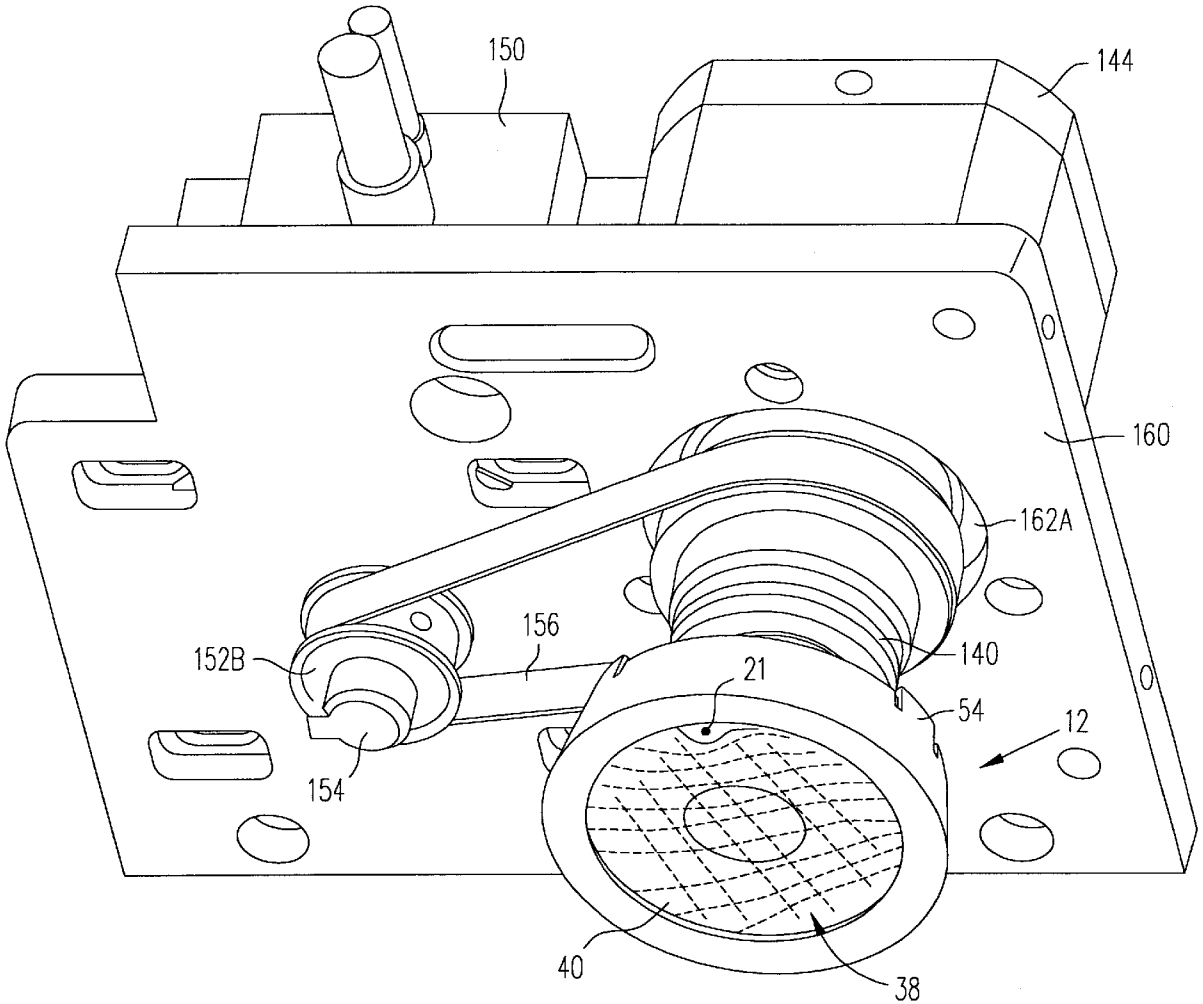
FIG. 23 is a front perspective view of the conditioner assembly and the motor assembly engaged to a support plate.
Figure 24:
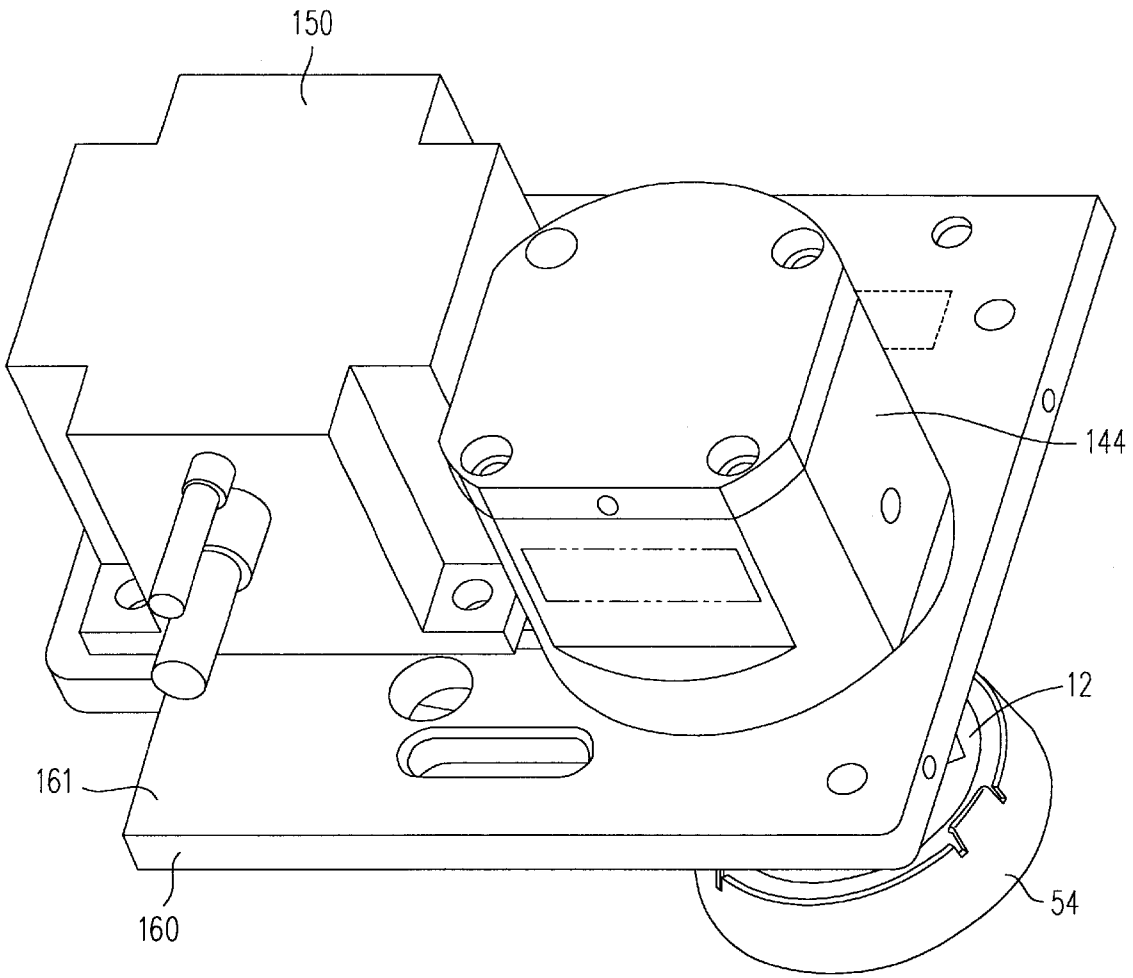
FIG. 24 is a rear perspective view of the conditioner assembly and the motor assembly engaged to the support plate.

Further structure of the linear torque bearing assembly 110 includes a purge port 128 and an outlet port 130 communicating with the purge port 128 through channel 132. As best illustrated in FIGS. 3 and 14, the outlet port 130 may be disposed in a casing cavity 134. The casing 112 may be manufactured from any suitable material, including metals and alloys, such as aluminum, stainless steel, etc.

Figure 2:
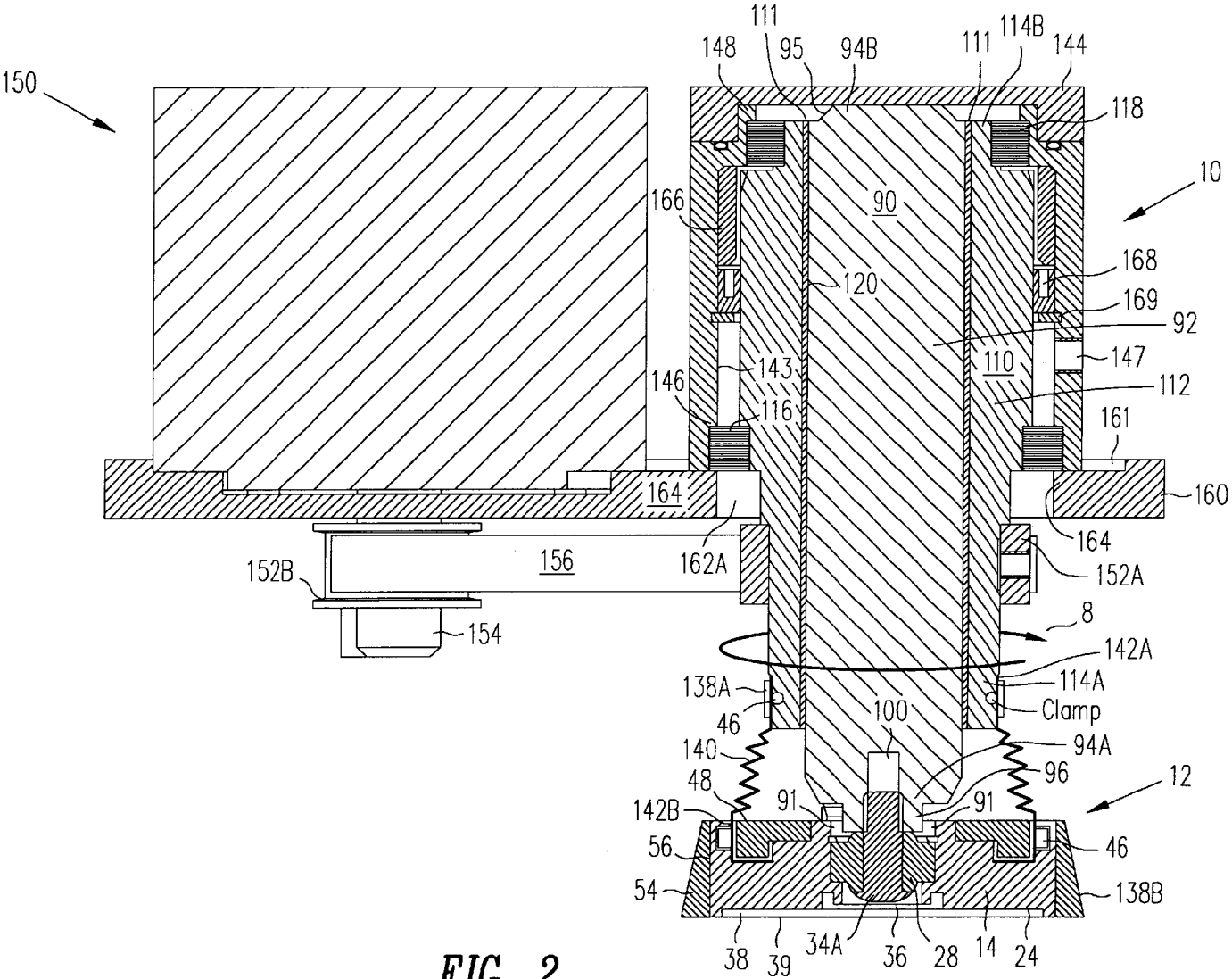
FIG. 2 is a cross sectional view of the conditioner assembly of FIG. 1, clearly illustrating the conditioning head having a gimbal assembly coupled to the shaft, the linear torque bearing assembly slidably engaged to the shaft, the bellows having a first lip engaged to a first open end of the linear torque bearing assembly and a second lip engaged to the conditioning head, and the bearing housing rotatably supporting a first and second case bearings of the linear torque bearing assembly.

The conditioner assembly 10 further includes a bellows 140 having a first lip 142A secured over the first open end 114A and a second lip 142B engaged to the conditioning head 12 (see FIGS. 2 and 3). A first clamp member 138A secures the first lip 142A over the first open end 114A. An "O" ring seal 46 is disposed in an outer annular indentation 136 of the casing 112 to seal the first lip 142A over the first open end 114A. Additionally a second clamp member 138B clamps the second lip 142B to the conditioning head 12. The bellows 140 is disposed over the purge port 128 such that pressure compressed in the bellows, as will be described later in the application, can be discharged through the outlet port 130.

The bearing housing 144 is configured to support the case bearings 116 and 118 such that the casing 112 is capable of rotating with respect to the bearing housing 144. As illustrated in FIGS. 2, 3, 4, and 19, the bearing housing 144 includes an inner cylindrical wall 143 structurally generally defined by a first shoulder 146 having a first inner diameter and a second shoulder 148 having a second inner diameter. The inner diameter of the first shoulder 146 is larger than the inner diameter of the second shoulder 148 for allowing the second open end 114B of the linear torque bearing assembly 110 to be inserted into the bearing housing 144 such that the first shoulder 146 mates with the first case bearing 116 and the second shoulder 148 mates with the second bearing 118. The bearing housing 144 is engaged to a backside 161 of a support plate 160 such that a portion of the casing 112, including the first open end 114A, penetrates through a first orifice 162A of the support plate 160. An inner rim region 164 of the orifice 162A compresses the first case bearing 116 against the first shoulder 146, causing the linear torque bearing assembly 110 to be rotatably secured to the bearing housing 144. Additionally, the inner cylindrical wall 143 of the bearing housing 144 may include a third shoulder 166 for supporting a sealing ring 168. The sealing ring 168, held in place by a support ring 169, seals the bearing housing 144 to the linear torque bearing assembly 110 such that a pressure/vacuum can be introduced through a housing inlet hole 145 to slidably extend and retract the shaft 90 through the first open end 114B. As mentioned before, the pressure that escapes through the clearance 111 compresses into the bellows 140. The purge port 128 communicating with the outlet port 130 allows for the discharged of the pressure. The bearing housing 144 includes a housing outlet hole 147 which allows the discharged pressure to be released from the bearing housing 144 (see FIG. 2).

To rotate the casing 112 a motor assembly 150 is employed with the conditioner assembly 10. A first gear 152A is circumferentially engaged to the casing 112. A drive shaft 154 of the motor assembly 150 includes a second gear 152B which is engaged to the first gear 152A by belt 156. The motor assembly 150 may also be engaged to the backside 161 of the support plate 160 such that the drive shaft 154 penetrates through a second orifice 162B of the support plate 160.

Figure 25:
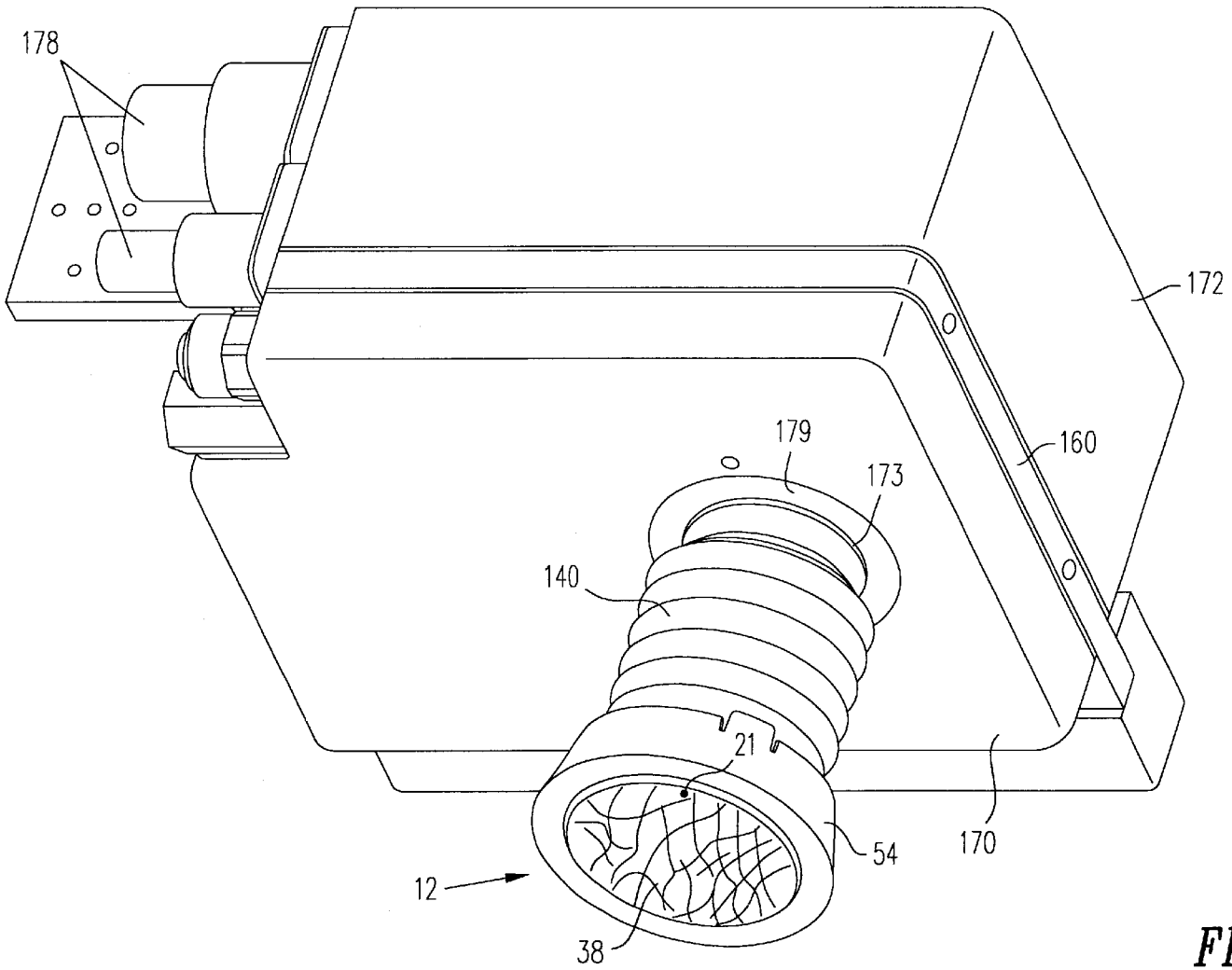
FIG. 25 is a perspective view of a pair of half-housing members coupled to a front and a backside of the support plate.
Figure 26:
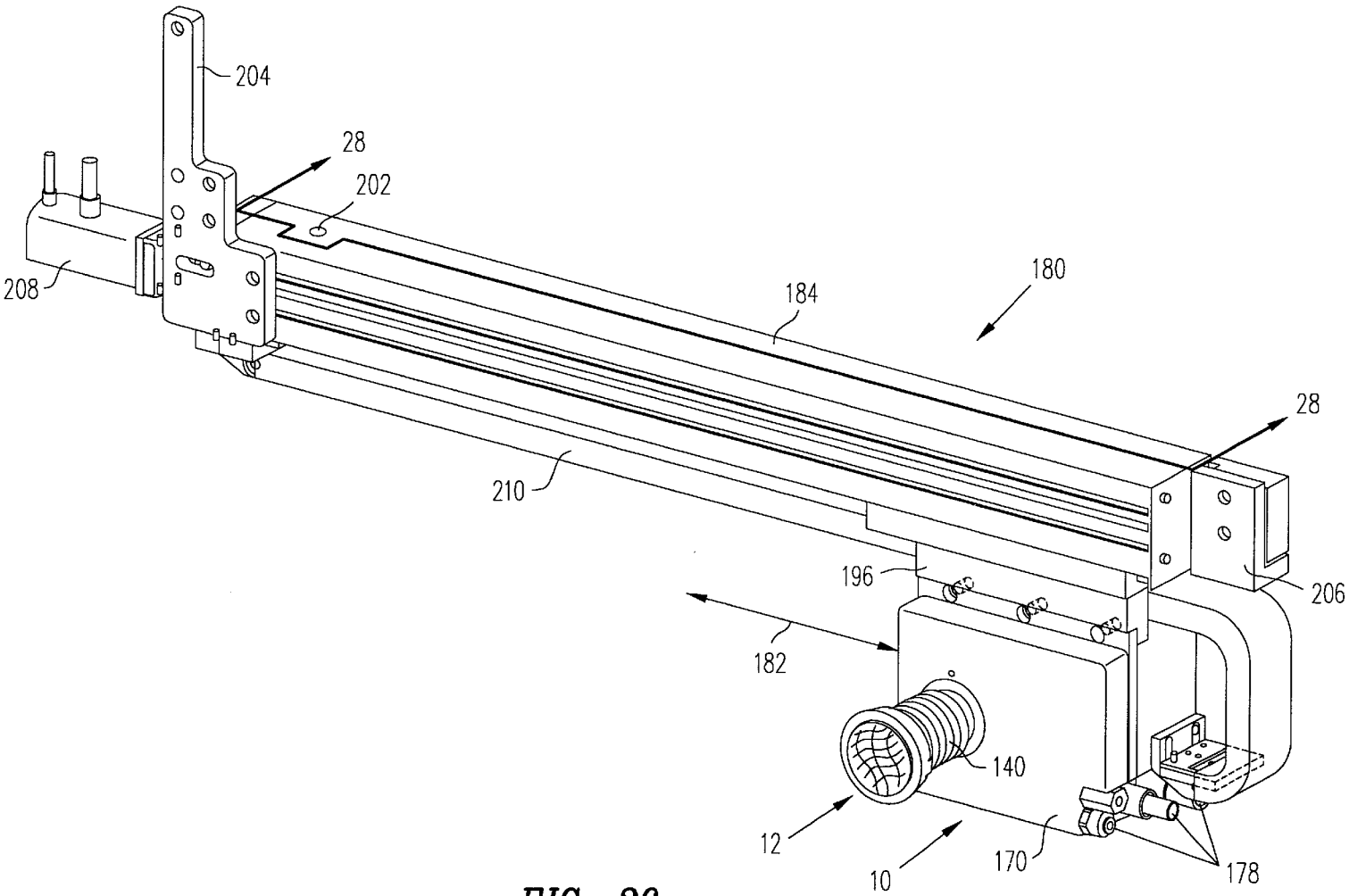
FIG. 26 is a front perspective view of a linear actuator assembly for actuating the conditioner assembly of the present invention back and forth across the polishing pad; the linear actuator comprises a tracking conveyor, a carriage movably engaged to the tracking conveyor, and a sleeve engaged to the tracking conveyor and the housing members.
Figure 27:
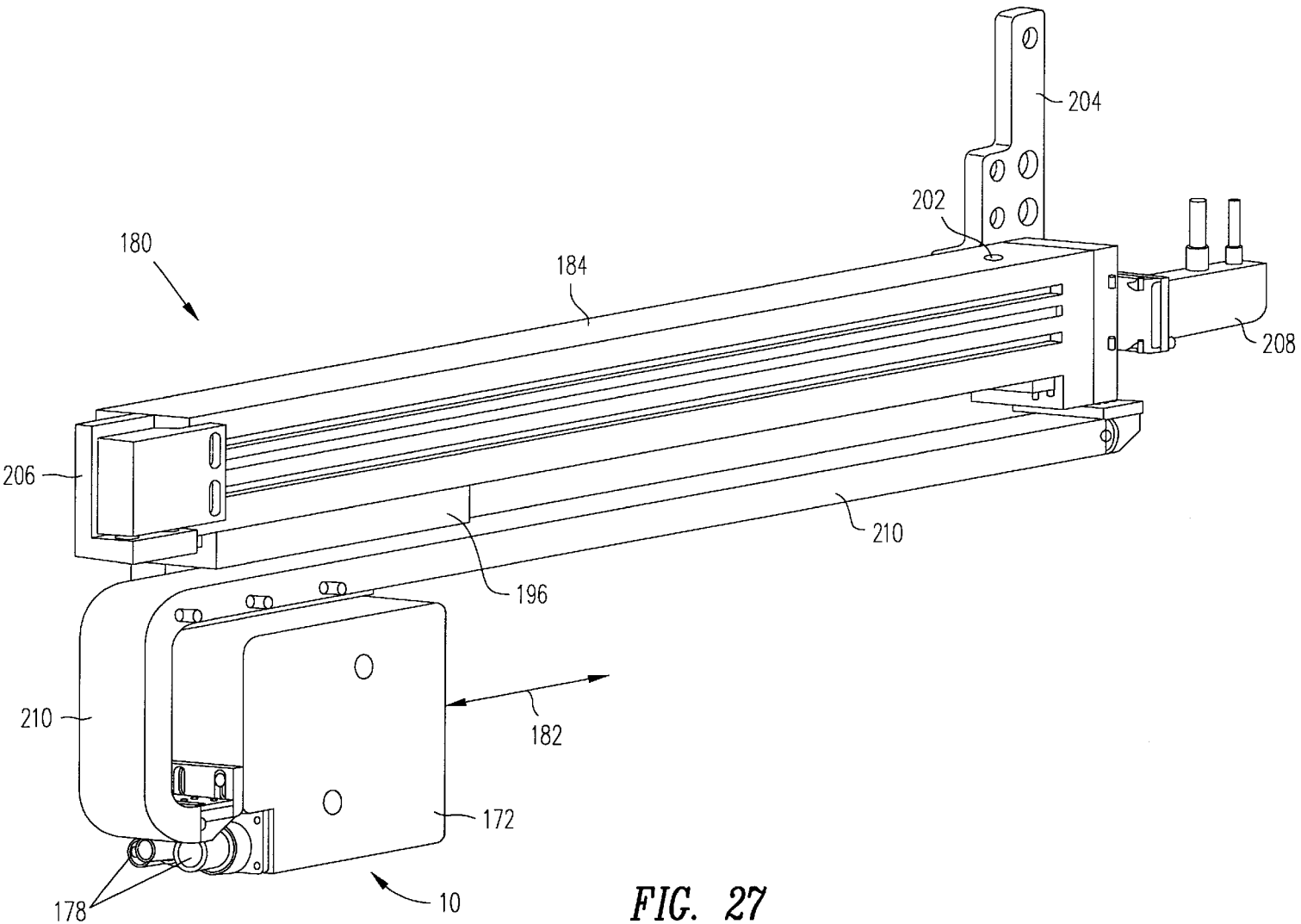
FIG. 27 is a rear perspective view of the linear actuator assembly of FIG. 27.

A pair of half-housing members, a front housing member 170 and a back housing member 172 are coupled and sealed, using sealing members 174, to a front 163 and the back 161 sides of the support plate 160, respectively. As illustrated in FIG. 25, the housing members 170 and 172 enclose the motor assembly 150, the bearing housing 144, and the linear torque bearing assembly 110. However, the first open end 114A of the casing 112 may extend through a passageway 173 of the front housing member 170. The conditioning head 12, including the bellows 140, are positioned outside the coupled housing members 170 and 172. A seal member 179 seals the passageway 173 against the first open end 114A. The back housing member 172 includes conduits 178 configured to provide electrical wires, pressure/vacuum tubes, sensor wires, etc. (omitted from the Figures) to the motor assembly 150 and the conditioner assembly 10. The housing members 170 and 172 may be manufactured from any suitable material which is resistant to any significant corrosion so as to protect the motor assembly 150 and the conditioner assembly 10. The material employed should also be capable of resisting significant erosion so as to avoid contaminating the slurry. Moreover, the material employed may resist any essential build-up of slurry on the surfaces of the housing members 170 and 172 so as to allow a user to clean the housing members 170 and 172. For example, the housing members 170 and 172 may be manufactured from aluminum coated with a polymer such as ethylenetetrafluoroethylene.

Figure 28:
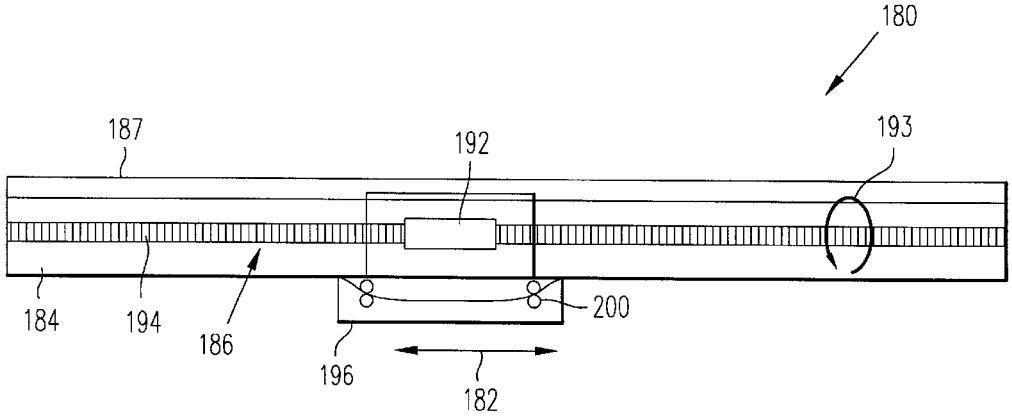
FIG. 28 is a cross sectional view of the tracking conveyor taken in the direction of the arrows and along the plane of line 28—28 of FIG. 26, illustrating a screw bearing assembly wherein a track bearing is engaged to the carriage.
Figure 29:
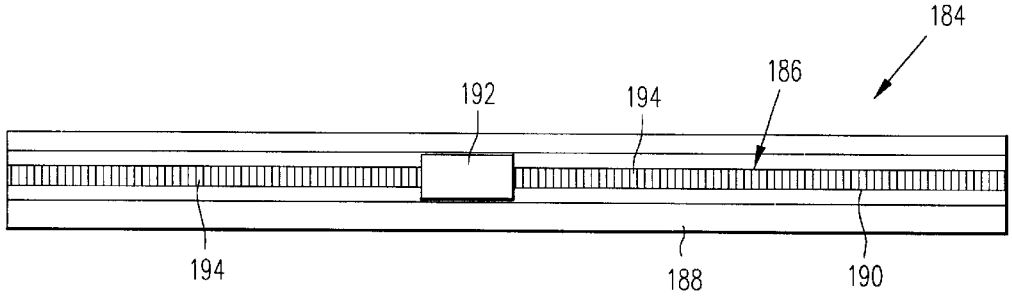
FIG. 29 is a bottom plan view of the tracking conveyor, illustrating a bottom wall having an access slot which allows the track bearing to be engaged to the carriage.
Figure 30:
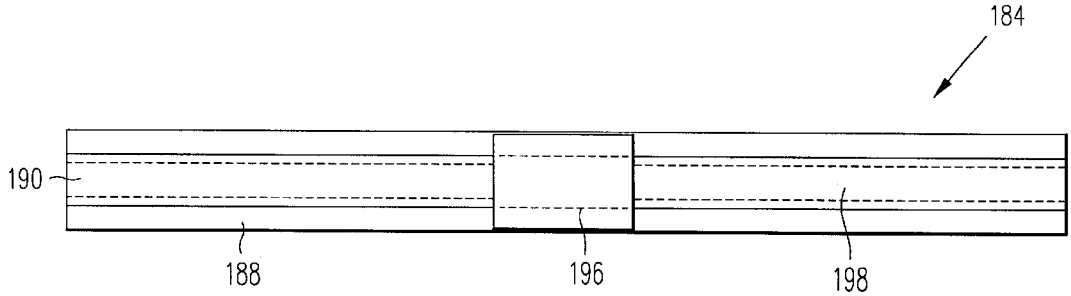
FIG. 30 is the bottom plan view of the tracking conveyor further illustrating a sealing tape disposed over the slot and penetrating through the carriage for preventing the slurry from penetrating through the slot.
Figure 31:
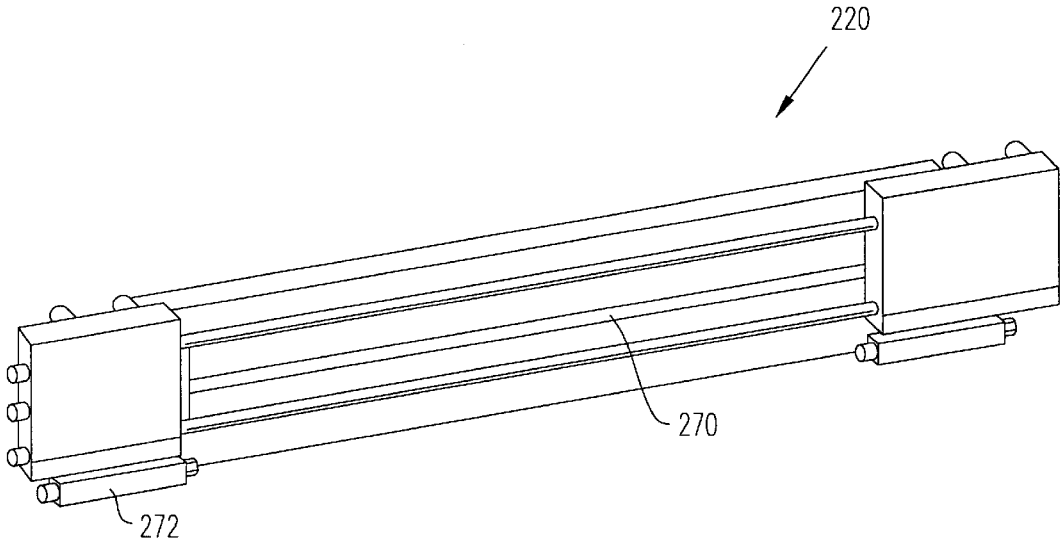
FIG. 31 is a rear perspective view of a conditioner back support in accordance with the present invention, the conditioner back support opposes the conditioner assembly such that the polishing pad is positioned intermediate to the conditioner assembly and the conditioner back support.
Figure 32:
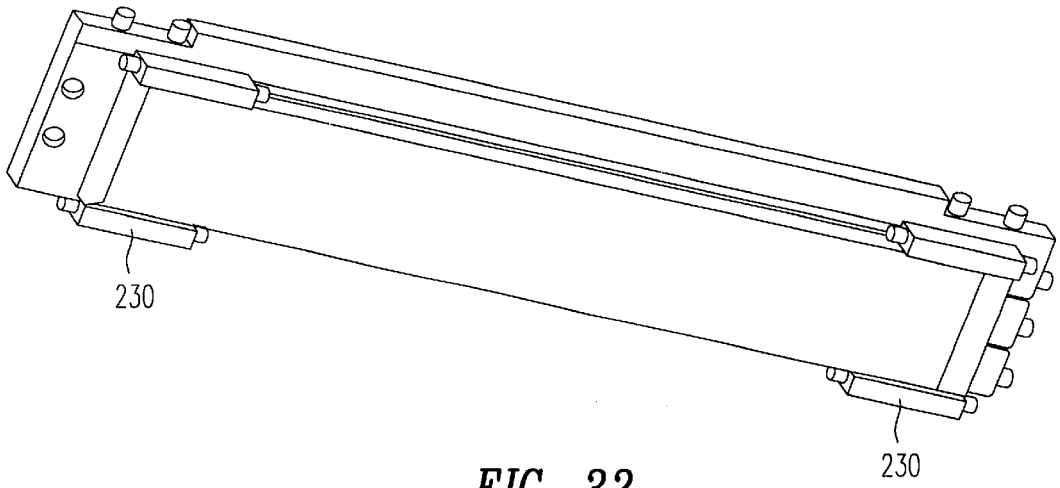
FIG. 32 is a front perspective of the conditioner back support of the present invention, illustrating a frame assembly adjustably supporting a backing plate.
Figure 33:
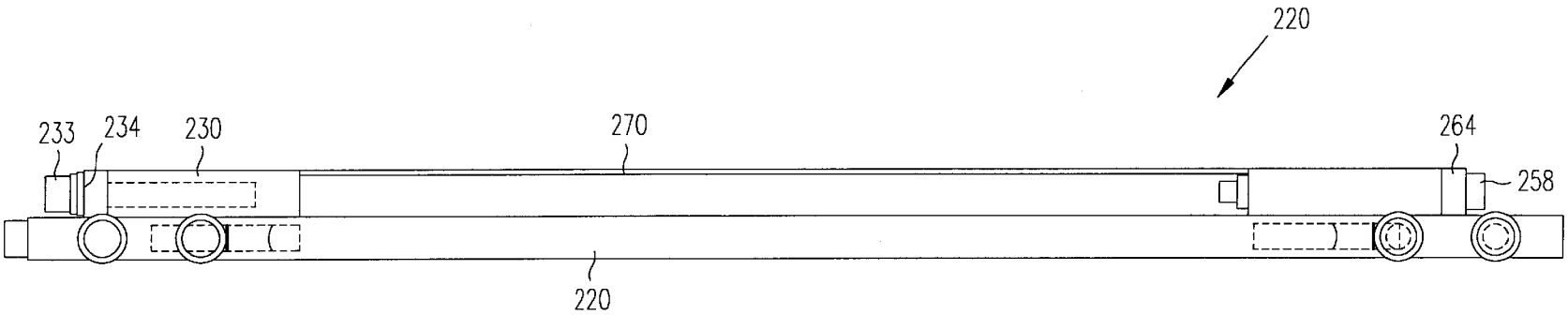
FIG. 33 is an end elevational view of the conditioner back support of the present invention.
Figure 34:
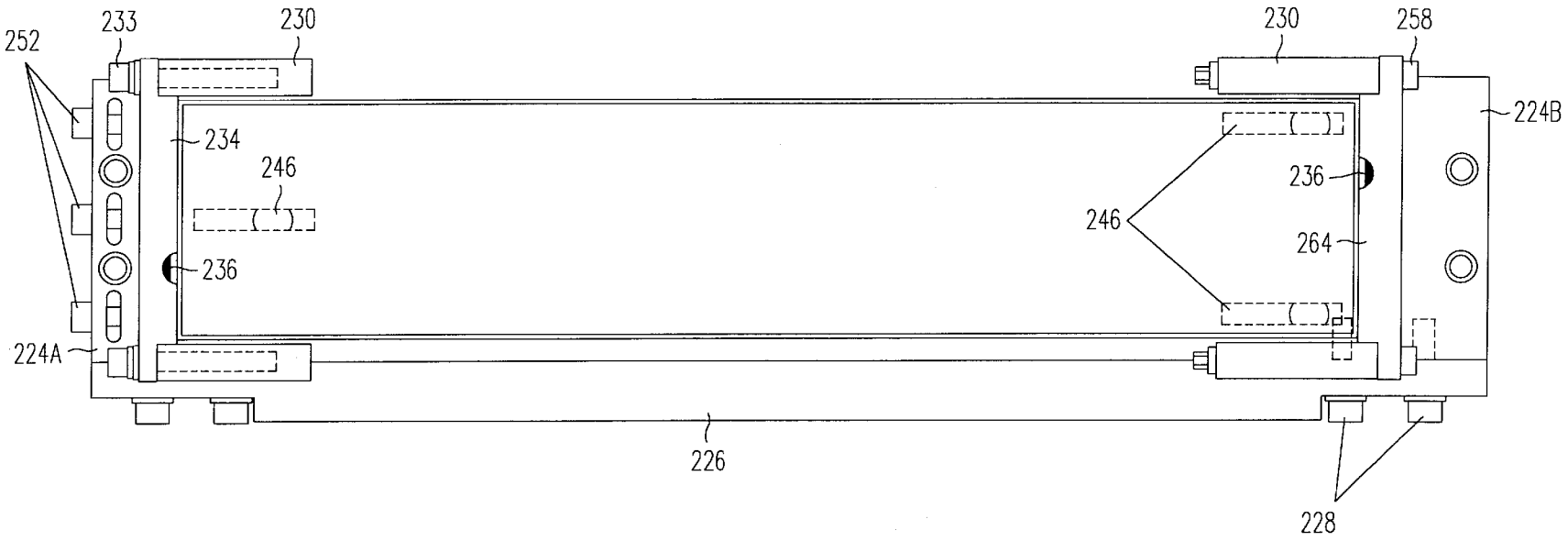
FIG. 34 is a front elevational view of the conditioning head of the present invention.

Referring now to FIGS. 26–30, a linear actuator assembly 180 actuates the conditioner assembly 10 back and forth, as indicated by arrows 182, across the polishing pad 304. The linear actuator assembly 180, comprises a tracking conveyor 184 for housing a screw bearing assembly 186, as illustrated in FIG. 28. A bottom wall 188 of the tracking conveyor 184 includes an access slot 190 for allowing a track bearing 192 of the screw bearing assembly 186 to be coupled to a carriage 196. Therefore, the rotation of a track screw 194 in a clockwise or counter clockwise direction, as indicated by arrow 193, actuates the carriage 196 in directions indicated by the arrows 182. A guide rail 187, disposed in the tracking conveyor 184, is slidably engaged to the carriage 196 for supporting the carriage 196. The carriage 196 is coupled to the support plate 160. A sealing tape member 198 is placed over the access slot 190 to prevent the slurry from penetrating into the tracking conveyor 184. As illustrated in FIG. 28, the sealing tape penetrates though the carriage 196 and is supported by rollers 200. In addition to the sealing tape 198, a track aperture 202 is provided to further seal the tracking conveyor 184 (see FIGS. 26 and 27). More specifically, the tracking conveyor 184 is pneumatically pressurized through the track aperture 202 so as to pneumatically seal the access slot 190. Flange members 204 and 206 are used to couple the linear actuator to a chemical mechanical polishing apparatus. A motor 208 is mounted to the tracking conveyor 184 for driving the track screw 194. The electrical wires, pressure/vacuum tubes, etc. are passed through a sleeve 210 which is coupled to the back housing member 172. As mentioned above, the electrical wires, pressure/vacuum tubes etc., are then coupled to the conduits 178 of the back housing member 172.

Figure 50:
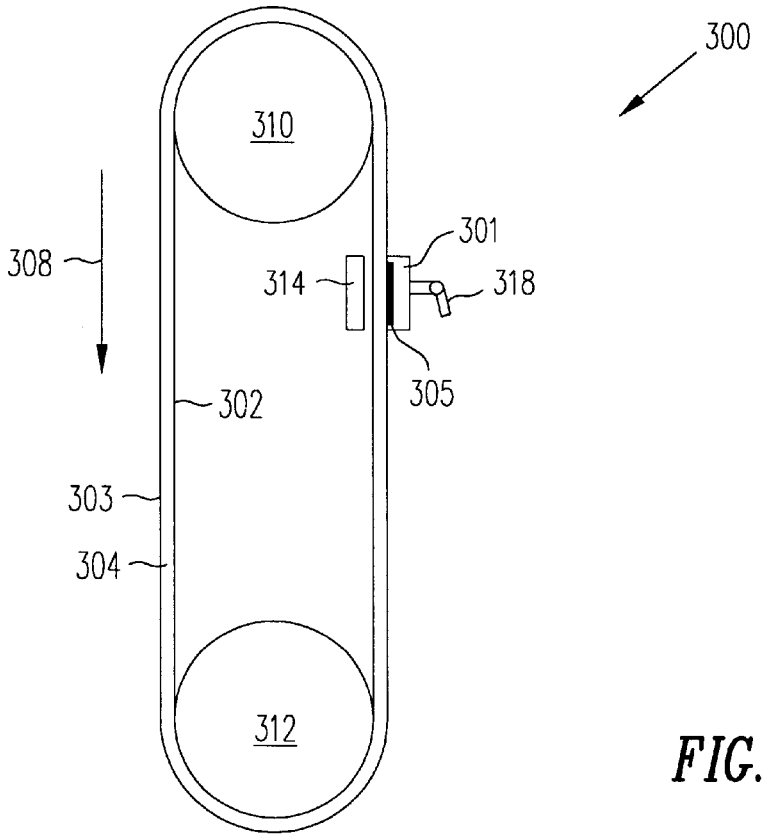
FIG. 50 is a schematic side elevational view of a linear chemical mechanical polishing apparatus for polishing a semiconductor wafer in which a polishing belt is driven about a pair of pulleys, a semiconductor wafer is positioned on a polishing pad by a polishing head, and a back support is opposing the polishing head.
Figure 51:
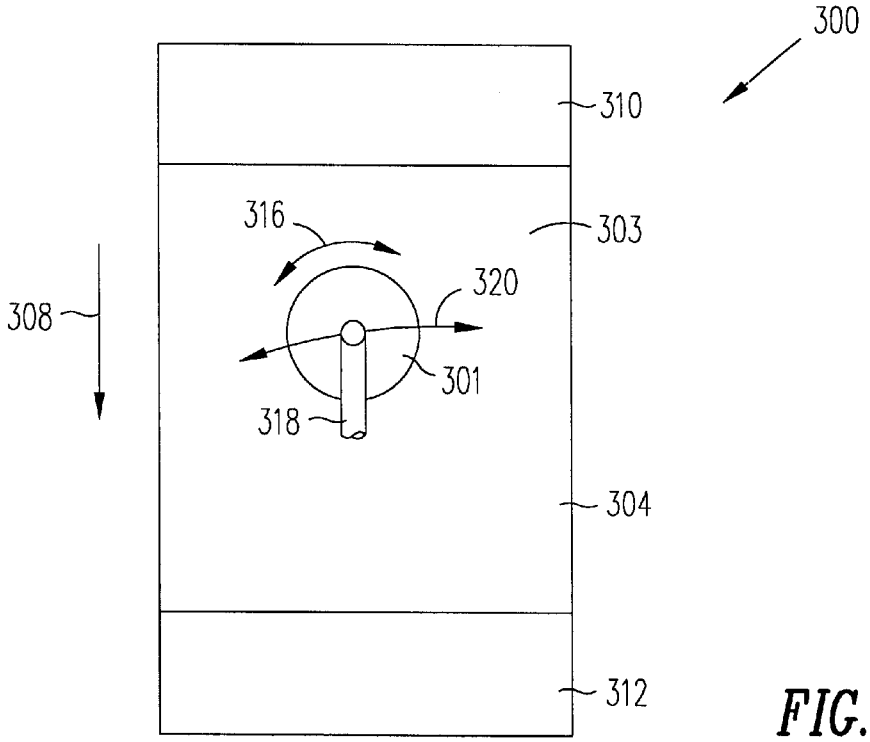
FIG. 51 is a schematic front elevational view of the linear chemical mechanical polishing apparatus of FIG. 50.
Figure 52:
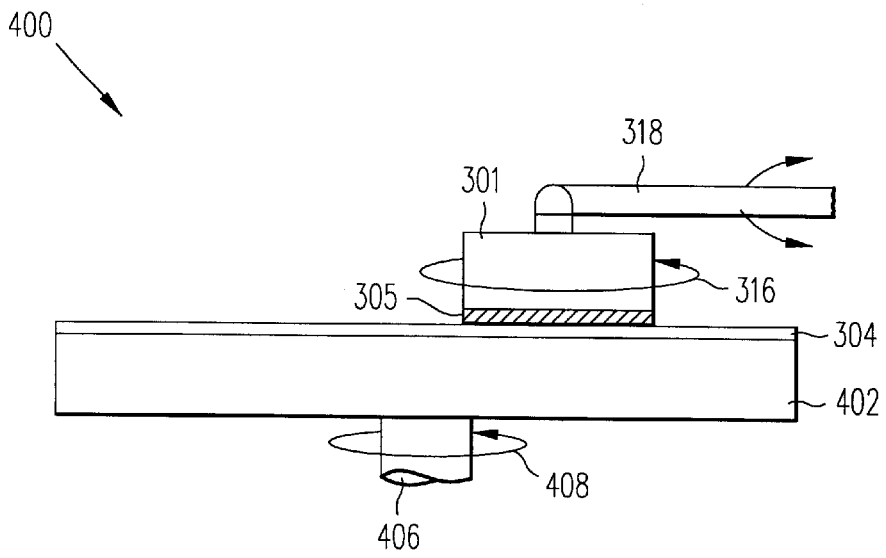
FIG. 52 is a schematic side elevational view of a planar chemical mechanical polishing apparatus for polishing a semiconductor wafer in which a polishing plate having a polishing pad is rotated about a shaft and a semiconductor wafer is positioned on the polishing pad by a polishing head.
Figure 53:
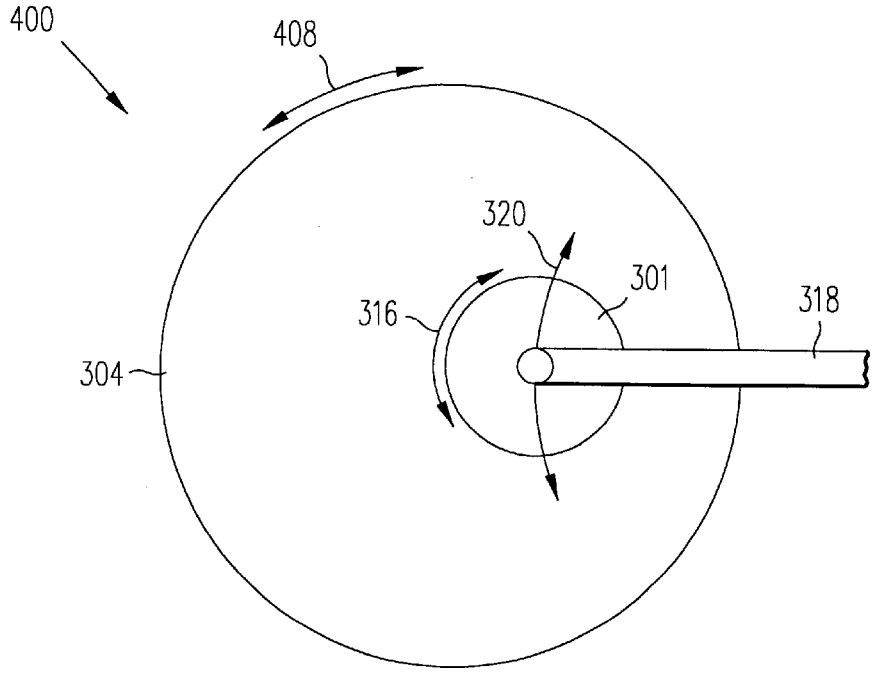
FIG. 53 is a schematic top plan view of the planar chemical mechanical polishing apparatus of FIG. 52.

To operate the conditioner assembly 10 using the linear chemical mechanical polishing device 300 of FIGS. 50 and 51 by way of example, a selected pressure (e.g., 1–60 psi) is applied to the shaft 90. The shaft 90 is extended in an outwardly direction, as indicated by arrows 6 (see FIG. 4) causing the conditioning pad 38 to apply a compressive pressure (e.g., 0.1–10 psi) against the polishing pad 304. The motor assembly 150 rotates the linear torque bearing assembly 110, which in turn operatively rotates the shaft 90, the conditioning head 12, and the conditioning pad 38 as illustrated by arrows 8. The compressive pressure applied to the polishing pad 304 by the conditioning pad 38 can be adjusted by increments of 0.1 psi during the conditioning process. Stated more practically, the conditioning pad 38 can maintain its rotation against the polishing pad 304 while the amount of compressive pressure that the conditioner pad 38 applies against the polishing pad 304 may be adjusted by increments of 0.1 psi. Moreover, the adjustments can be made during the chemical mechanical polishing of a substrate, i.e., in-situ conditioning, or before and/or after the chemical mechanical polishing process, i.e., ex-situ conditioning. The linear actuator assembly 180 oscillates the conditioner assembly back and forth, as indicated by the arrow 182. During the conditioning process, the polishing pad 304 is driven in a direction of arrow 308, different than the oscillation direction 182 of the conditioner assembly 10. For example, the conditioner assembly 10 may oscillate in a direction perpendicular to the movement of the polishing pad 304. The polishing pad 304 is preferably conditioned during the chemical mechanical polishing of a substrate, i.e., in-situ conditioning. The polishing pad 304 may also be conditioned before and/or after the chemical mechanical polishing of a substrate, i.e., ex-situ conditioning.

After the completion of the conditioning process, a vacuum pressure is applied to the shaft 90 to retract the shaft in an inwardly direction 6. The shaft 90 may be retracting during the rotation of the casing 112 or after the termination of the rotation of the casing 112.

Figure 35:
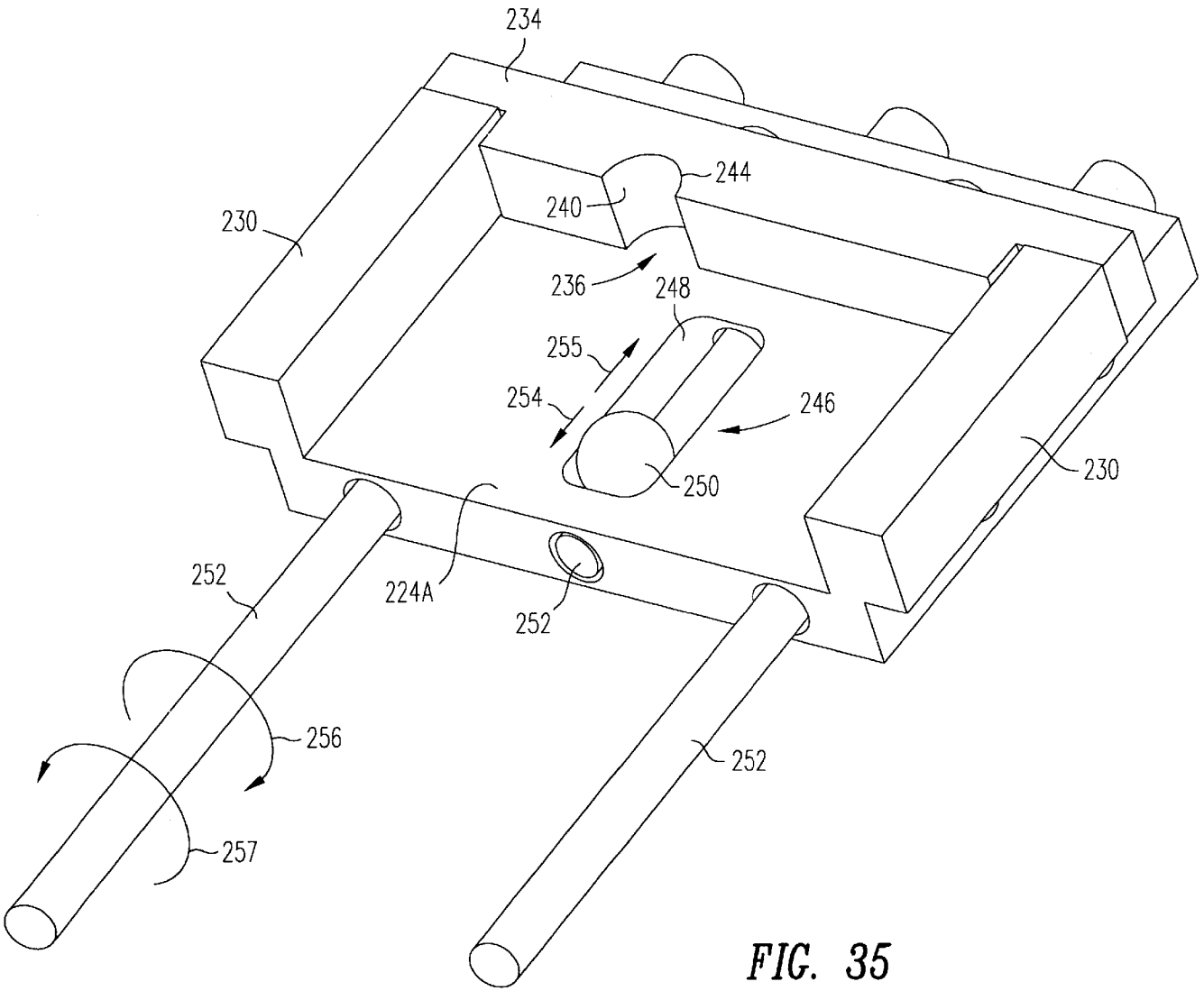
FIG. 35 is a perspective view of a first end plate of the frame assembly, the first end plate comprises a support block member, releasably coupled to a pair of lugs, and a positioning assembly.

The present invention additionally provides a back support, generally illustrated as 220, for a chemical mechanical polishing apparatus, such as the linear chemical mechanical polishing apparatus 300 of FIGS. 50 and 51. The back support 220 respectively opposes a conditioner assembly such as the conditioning assembly 10 of the present invention. The polishing pad 304 is positioned intermediate to the back support 220 and the conditioner assembly 10. Referring to FIGS. 31–49, the back support 220 comprises a frame assembly 222. The frame assembly 222 includes a pair of end plates 224A and 224B coupled to a joist 226 by frame screws 228. A pair of lugs 230 are integrally bound to the first end plate 224A (see FIG. 35). The lugs 230 have lug apertures 232 for capturing block screws 233. The back support 220 additionally comprises a support block member 234. The support block member 234 includes a knob cavity 236 indented therein and block apertures 238 also formed therein. The block apertures 238 register with the lug apertures 232 such that the support block member 234 is disengagably coupled to the lugs 230 with the block screws 233. As shown in FIGS. 38–41, the knob cavity 236 is defined by opposed sidewalls 240 and 242 having a common end wall 244. The end wall 244 is structurally defined a radius of curvature $\rho$, configured to receive a tooling knob 274, as will be described in detail below. Moreover, the end wall 244 is defined by a slope having an angle $\phi$, ranging from about 20 degrees to about 80 degrees, more preferably ranging from about 30 degrees to about 60 degrees, and most preferably ranging from about 35 to about 45 degrees. Further structure of the first end plate 224A, as illustrated in FIG. 35, includes a positioning assembly 246 disposed in a plate slot 248 for adjusting a position of a backing plate 270, as will be described in detail below. The positioning assembly 246 comprises a plug 250 threaded on a screwing rod 252. The plug 250 is capable of being driven in an inwardly and outwardly direction, as indicated by arrows 254 and 255, by turning the screwing rod in a clockwise and counter clockwise direction, as indicated by arrows 256 and 257. The distance that the plug 250 can move in the inwardly 254 and the outwardly direction 255 is limited by the length of the plate slot 248. It is understood, other forms of positioning assemblies 246 may be employed with the back support 220 of the present invention. For example, the frame assembly 222 may include a pneumatic, a hydraulic, or an electronic actuator (omitted from the Figures), as is well known to persons skilled in the art, to adjust the position of the backing plate 270.

Figure 36:
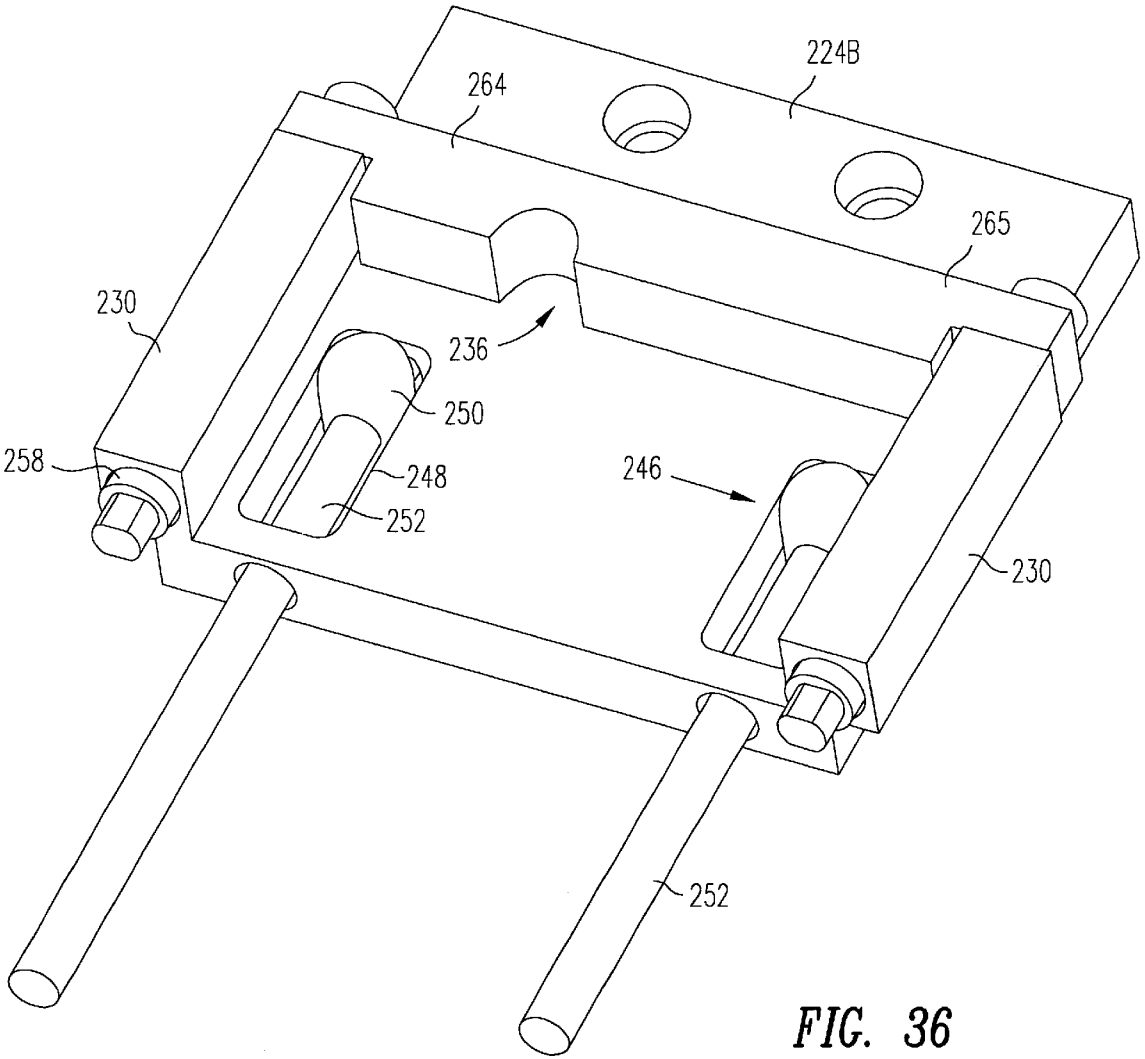
FIG. 36 is a perspective view of a second end plate of the frame assembly, the second end plate comprises a spring block member, biasedly coupled to a pair of lugs, and the positioning assembly.
Figure 37:
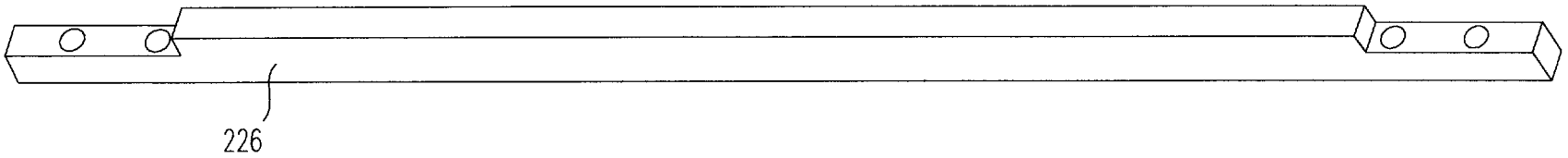
FIG. 37 is a perspective view of a joist which is coupled to the end plates.
Figure 38:
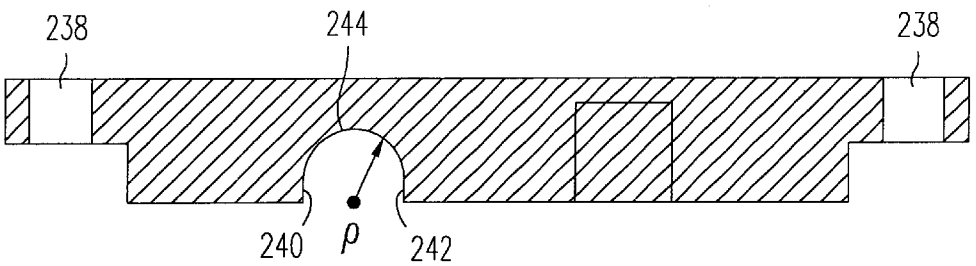
FIG. 38 is the top plan view of the support block member and the spring block member, including a knob cavity indented therein and block apertures also formed therein; the knob cavity is defined by opposed side walls having a common end wall, wherein the end wall is sloped and has a radius of curvature.
Figure 39:
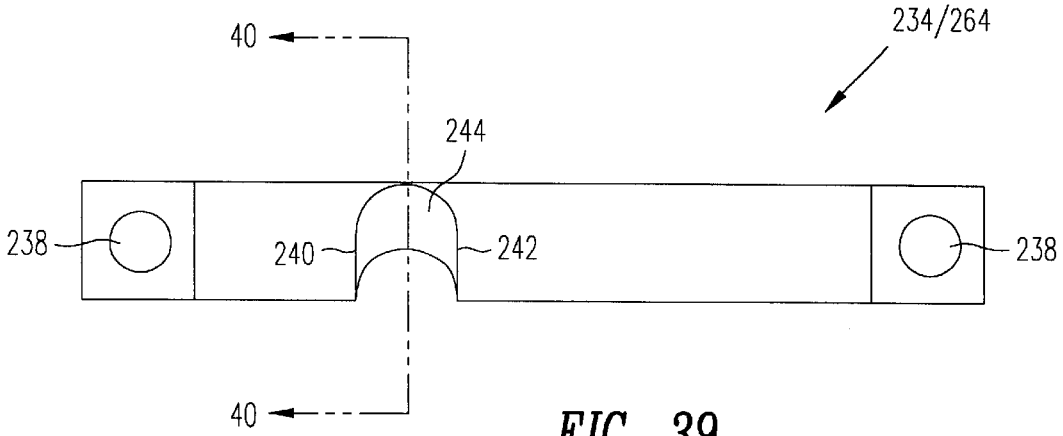
FIG. 39 is a front elevational view of the support and the spring block members.
Figure 40:
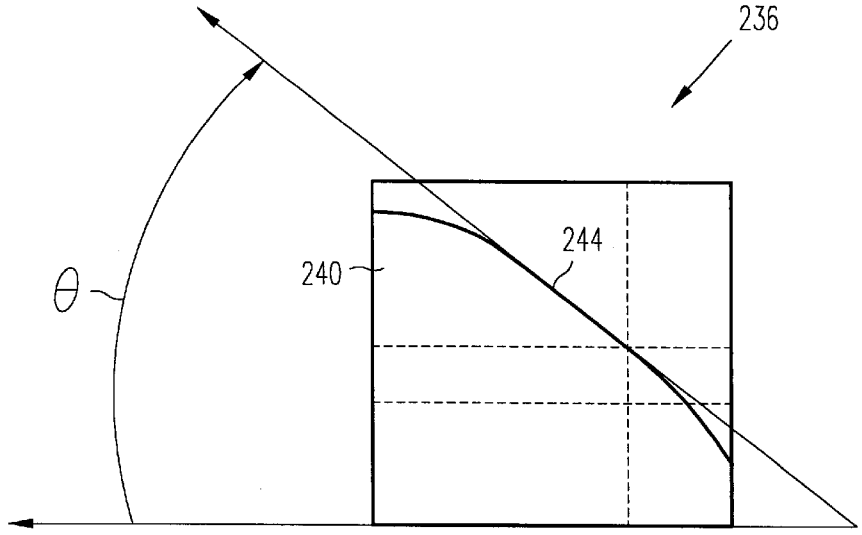
FIG. 40 is a side cross sectional view of the support and the spring block members taken in the direction of the arrows and along the plane of line 40—40 of FIG. 39, clearly illustrating the end wall having a slope defined by an angle $\phi$.
Figure 41:
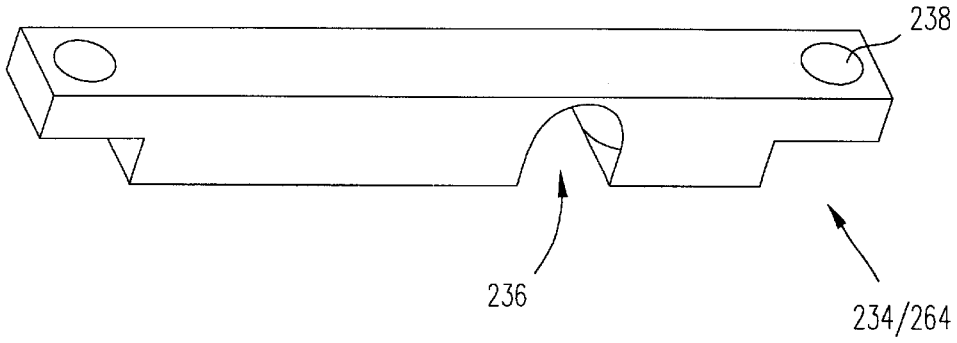
FIG. 41 is a perspective view of the support and spring block members.
Figure 42:
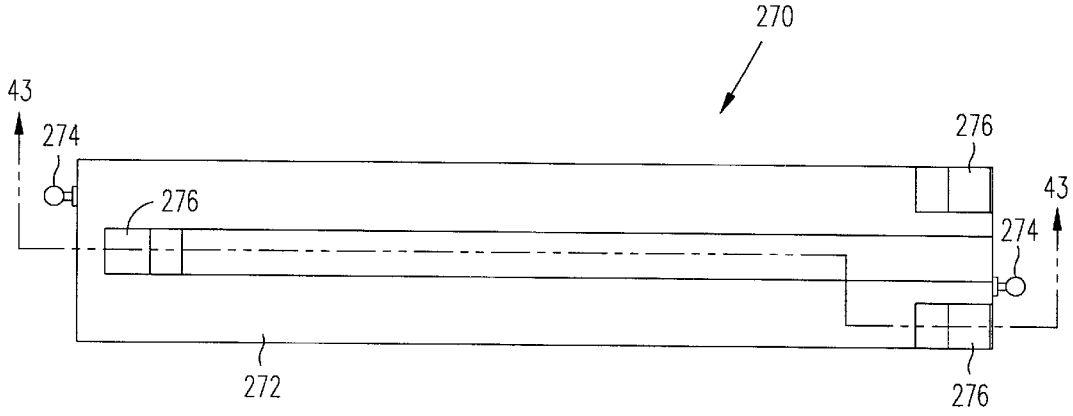
FIG. 42 is a rear elevational view of the backing plate for the conditioner back support of the present invention, illustrating a structure defined by a rectangular plate having a pair of tooling knobs coupled thereto and a plurality of tapered troughs formed therein.
Figure 43:
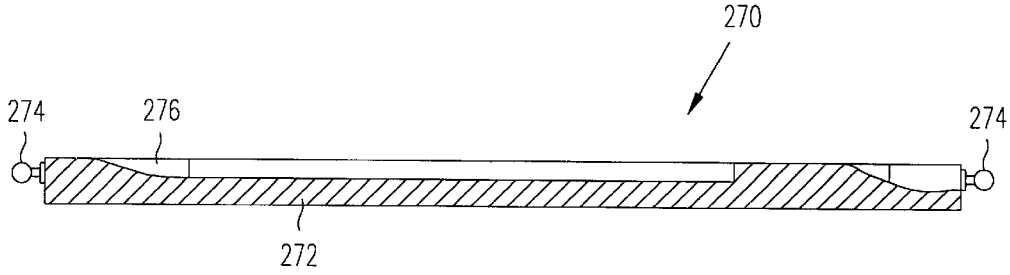
FIG. 43 is a sectional view of the backing plate for the conditioner back support of the present invention taken in the direction of the arrows and along the plane of line 43—43 of FIG. 42, illustrating the tapered troughs formed in a backside of the rectangular plate.
Figure 44:
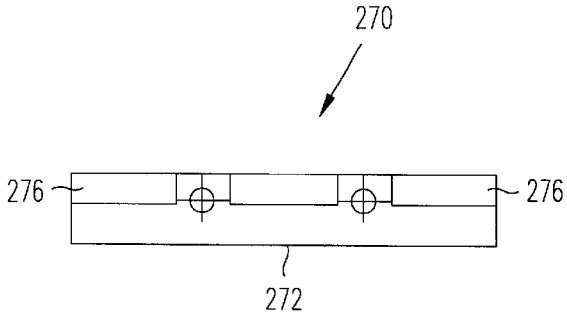
FIG. 44 is an end elevational view of the backing plate.
Figure 45:
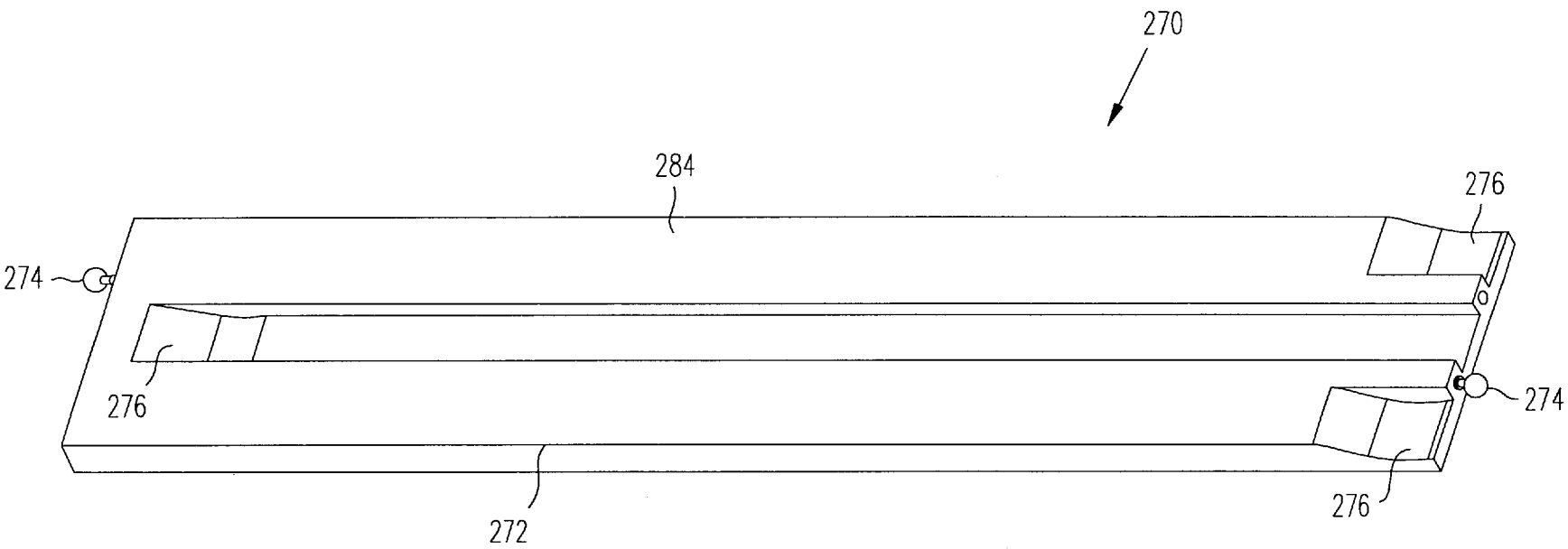
FIG. 45 is a rear perspective view of the backing plate for the conditioner back support of the present invention.

Referring now to FIG. 36, the second end plate 224B also comprises a pair of the lugs 230 having the lug apertures 232. However, unlike the first end plate 224A, the lug apertures 232 for the second end plate 224B capture a spring pin assembly 258. The spring pin assembly 258 comprises springs 260 engaged to pins 262 (see FIG. 49). The spring pin assembly 258 biasedly couples a spring block member 264 to the lugs 230 such that the spring block member 264 can be biasedly actuated in the direction of arrow 265. The spring block member 264 is structurally similar to the support block assembly 234 in that the spring block member 264 also includes the knob cavity 236 and block the apertures 238. Further structure of the second end plate 224B includes the positioning assembly 246. The positioning assembly 246 for the second end plate 224B comprises a pair of the plugs 250 disposed in plate slots 248 and threaded to the screwing rods 252. The plugs 250 are positioned at a selected distance from one another. As stated above, the plugs 250 for the positioning assembly 246 can move in the direction of arrows 254 and 255 by rotating the screwing rods 252 in a clockwise or counter clockwise direction, as indicated by the arrows 256 and 257, respectively. The spring block member 264 complyingly compress the backing plate 270 against the positioning assembly 246 of the first 224A and second 224B end plates. As a result, the backing plate 270 is adjustably supported by the frame assembly 222; as will be described in detail below.

Referring now to FIGS. 42–45 the backing plate 270 is structurally defined by a rectangular plate 272 having a pair of tooling knobs 274 coupled thereto and tapered troughs 276 formed on a backside 284 thereof. The backing plate 270 is adjustably engaged to the frame assembly 222 by removing the support block member 234 from the lugs 230 by unscrewing the block screws 233. The backside 284 of the backing plate 270 is positioned against the end plates 224A and 224B such that one of the tooling knobs 274 is received by the knob cavity 236 of the spring block member 264. Each of the tapered troughs 276 communicates with one of the plugs 250 of the positioning assembly 246. The support block member 234 is coupled to the lugs 230 by the block screws 233 such that the knob cavity 236 of the support block member 234 receives the second of the tooling knobs 274.

Figure 46:
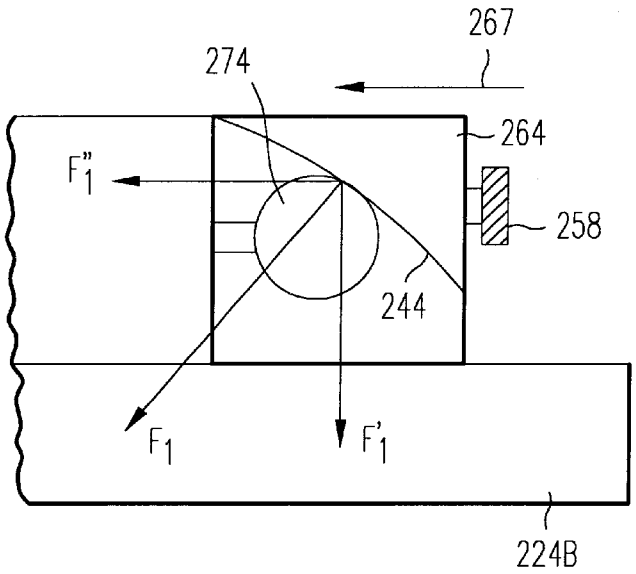
FIG. 46 is a partial cross sectional view of the conditioner back support of the present invention, demonstrating the operation of the spring block member, wherein the spring block member biasedly compresses the tooling knob in an inwardly direction which causes the end walls of the knob cavities, for both the spring and support block members, to apply forces against the tooling knobs of the backing plate.
Figure 46:
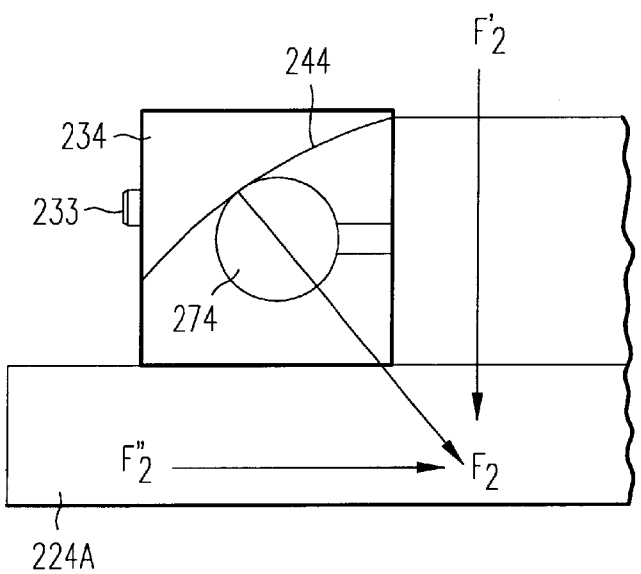

Referring to FIG. 46 for the operation of the spring block member 264, the spring pin assembly 258 biasedly compresses the spring block assembly 264 in an inwardly direction, as indicated by arrow 267. As a result, the end wall 244 of the knob cavity 236 applies a force $F_1$ against the tooling knob 274. Because the end wall 244 has a slope defined by the angle $\phi$, the force $F_1$ yields both a force $F'_1$ in a vertical direction and a force $F''_1$ in the horizontal direction against the tooling knob 274. The vertical force $F'_1$ adjustably compresses the tapered troughs 276 against the plugs 250 of the positioning assembly 246 for the second end plate 224B. The horizontal force $F''_1$ compresses the second tooling knob 274 against the support block member 234 by a force $F_2$. Again, $F_2$ can be divided into a vertical force $F'_2$ and a horizontal force $F''_2$. The vertical force $F'_2$ adjustably compresses the tapered troughs 276 against the plug 250 of the positioning assembly 246 for the first end plate 224A.

Figure 47:
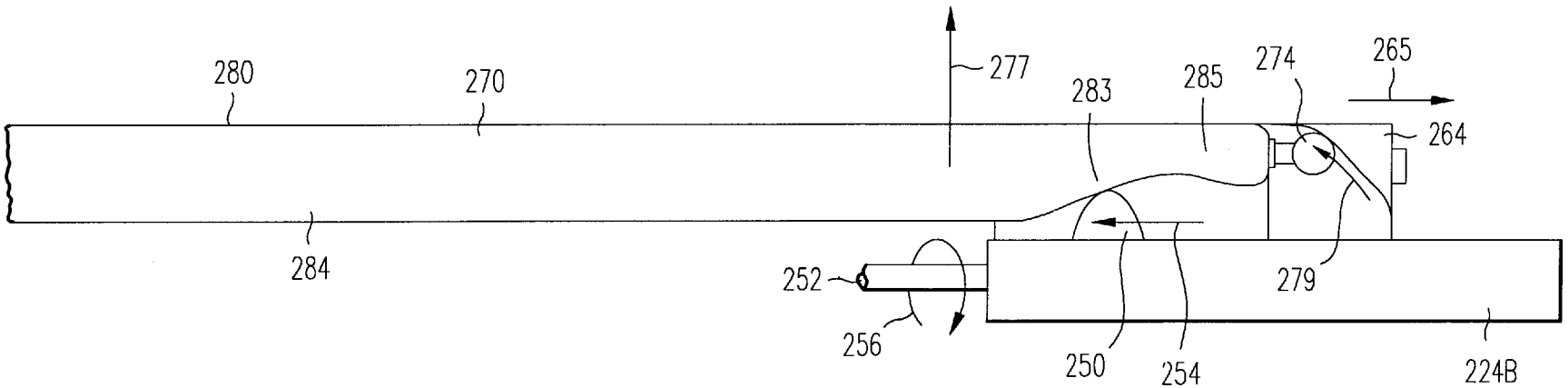
FIG. 47 is a partial cross sectional view of the conditioner back support of the present invention, demonstrating the operation of the positioning assembly, wherein the clockwise rotation of a screwing rods moves a plug in an inwardly direction causing the backing plate to be adjustably positioned with respect to the frame assembly.
Figure 48:
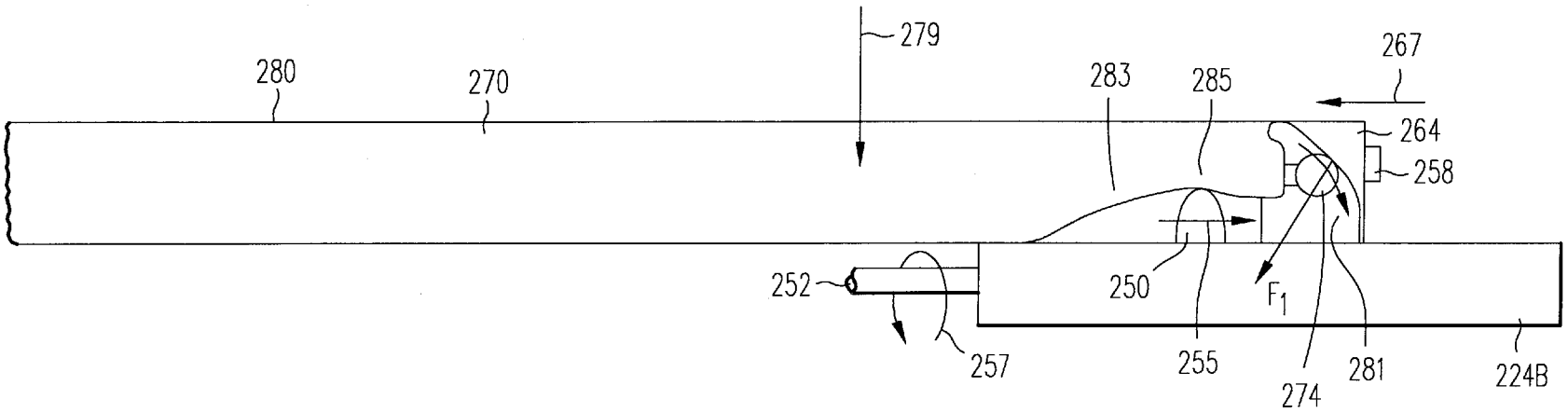
FIG. 48 is a partial sectional view of the conditioner back support of the present invention, demonstrating the operation of the positioning assembly, wherein the counter clockwise rotation of the screwing rod moves the plug in an outwardly direction causing the backing plate to be adjustably positioned with respect to the frame assembly.
Figure 49:
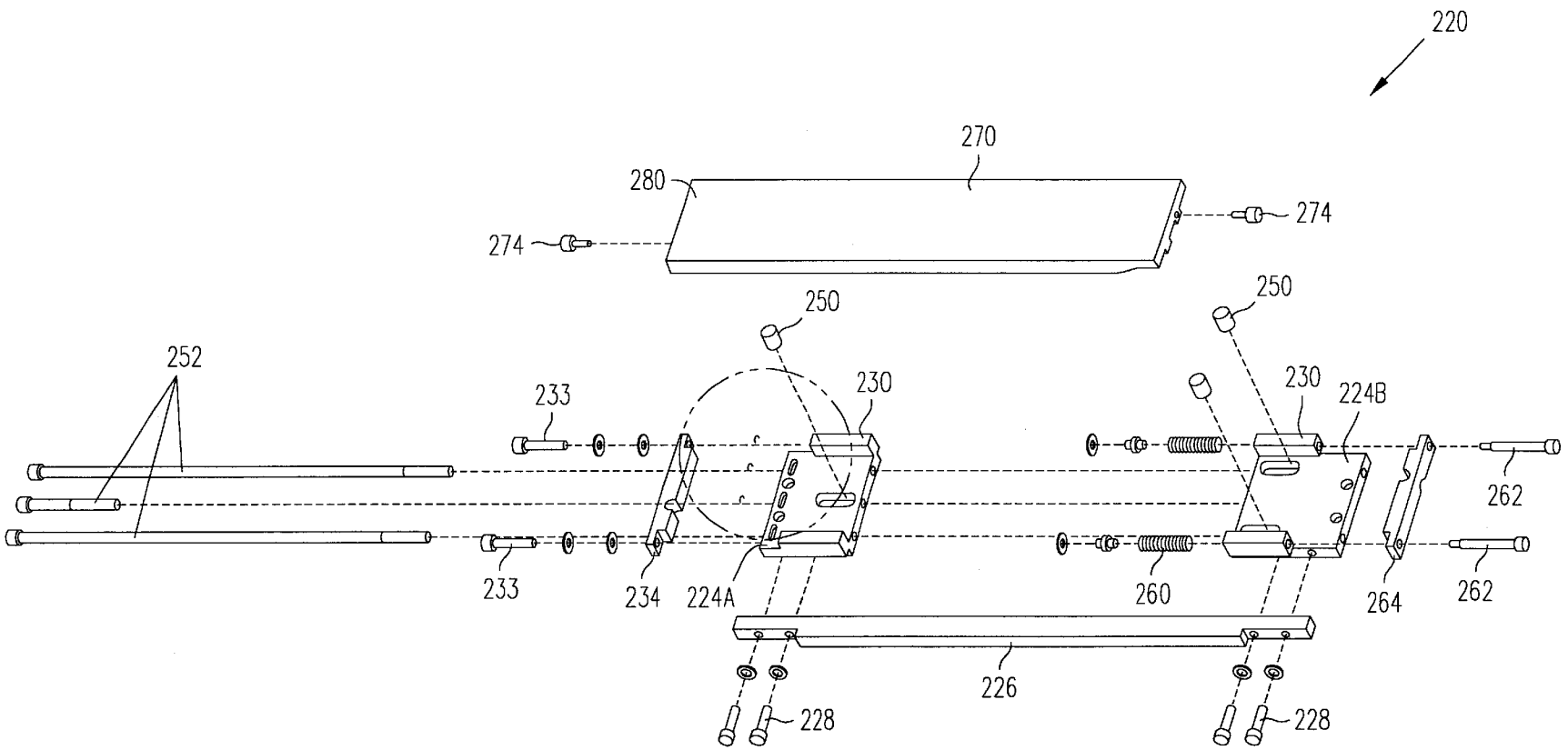
FIG. 49 is an exploded view of the conditioner back support assembly of the present invention.

Referring to FIGS. 47 and 48 for the operation of the positioning assembly 246, the screwing rod 252 is rotated in a clockwise direction 256 causing the plug 250 to move in the inwardly direction 254. By moving the plug 250 towards a thick region 283 of the tapered trough 276, the plug 250 presses the backing plate 270 in the direction of arrow 277. Moreover, as best illustrated in FIG. 47, the tooling knob 274 slidably moves along the end wall 244 in the direction of arrow 279, which causes the spring block member 264 to be biasedly moved in an outwardly direction, as indicated by the arrow 265. For moving the backing plate 270 in the direction of arrow 279 as illustrated in FIG. 48, the procedure is reversed. More specifically, the screwing rod 252 is rotated in a counterclockwise direction 257 causing the plug 250 to move in the outwardly direction 255, i.e., towards a thin region 285 of the tapered trough 276. As mentioned above, the spring block member 264, biased in the direction of the arrow 267, applies the compressive force $F_1$ against the tooling knob 274, causing the tooling knob 274 to slidably move along the end wall 244 in the direction of arrow 281. As a result, the backing plate 270 is moved in the direction of the arrow 279. By providing a positioning assembly 246 comprising of at least three plugs 250, a front surface 280 of the backing plate 270 can be positioned parallel to and generally communicating with a plane defined by a back surface of the a polishing belt 302.

In order to reduce friction between the front surface 280 of the backing plate 270 and the back surface of the polishing belt 302 any suitable material having a low coefficient of friction may be disposed on the front surface 280 of the backing plate 270. The materials may include any suitable polymeric compound including polyethylene, polytetrafluoroethene (PTFE), epoxy resins, etc.

Thus, while the present invention has been described herein with reference to particular embodiments thereof, a latitude of modifications, various changes and substitutions are intended in the foregoing disclosure, and it will be appreciated that in some instances some features of the invention will be employed without a corresponding use of the other features without departing from the scope of the present invention as set forth.

We claim:

1. A chemical mechanical polishing device, comprising:

a) a polishing pad;

b) a conditioner assembly configured to condition said polishing pad; and c) a conditioner back support assembly respectively opposing said conditioner assembly, such that said polishing pad is positioned intermediate to said conditioner assembly and said conditioner back support assembly, said conditioner back support assembly comprising a frame assembly and a backing plate adjustably supported by said frame assembly, wherein said frame assembly comprises a positioning assembly configured to adjust a position of said backing plate and a spring block assembly adapted to complyingly compress said backing plate against said positioning assembly.

2. A back support assembly for a conditioner assembly of a polishing apparatus, comprising:

a frame assembly; and a backing plate adjustably supported by said frame assembly, wherein said frame assembly comprises a positioning assembly configured to adjust a position of said backing plate and a spring block assembly adapted to complyingly compress said backing plate against said positioning assembly.

3. The back support assembly of claim 2, wherein said backing plate comprises a plurality of tapered troughs formed on a backside thereof for respectively communicating with said positioning assembly.

4. The back support assembly of claim 2, additionally comprising a polymeric compound disposed on a front face of said backing plate.

5. The back support assembly of claim 4, wherein said polymeric compound comprises polyethylene.

6. The back support assembly of claim 4, wherein said polymeric compound comprises an epoxy resin.

7. The back support assembly of claim 4, wherein said polymeric compound comprises polytetrafluoroethene.

8. A method for conditioning a moving polishing pad of a polishing apparatus, said polishing pad moving in a first direction, the method comprising:

a) providing a conditioner assembly;

b) providing a back support assembly having a backing plate opposing said conditioner assembly, wherein said polishing pad is positioned intermediate to said back support assembly and said conditioner assembly;

c) adjusting a position of said backing plate such that a front surface of said backing plate is parallel to and generally communicating with a plane defined by a backside of said polishing pad;

d) compressing said conditioner assembly against said polishing pad without any essential deflection in said polishing pad; and e) conditioning said polishing pad.

9. The method of claim 8, wherein said conditioning step (e) comprises, oscillating said conditioner assembly in a second direction different from said first direction.

10. The method of claim 8, wherein said conditioning step (e) additionally comprises, rotating said conditioner assembly.

* * * * *

UNITED STATES PATENT AND TRADEMARK OFFICE

CERTIFICATE OF CORRECTION

PATENT NO. : 6,322,429 B1
DATED : November 27, 2002
INVENTOR(S) : Ethan C. Wilson et al.

It is certified that error appears in the above-identified patent and that said Letters Patent is hereby corrected as shown below:

Column 3,
Line 66, delete “to the” and insert -- torque --

Column 12,
Line 15, delete “discharged” insert -- discharge --

Signed and Sealed this

Thirty-first Day of December, 2002

JAMES E. ROGAN
*Director of the United States Patent and Trademark Office*